US009311844B2

(12) United States Patent
Yang

(10) Patent No.: US 9,311,844 B2
(45) Date of Patent: Apr. 12, 2016

(54) SOURCE DRIVER AND METHOD TO REDUCE PEAK CURRENT THEREIN

(71) Applicant: Novatek Microelectronics Corp., Hsinchu (TW)

(72) Inventor: Shun-Hsun Yang, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 323 days.

(21) Appl. No.: 14/083,446

(22) Filed: Nov. 19, 2013

(65) Prior Publication Data

US 2015/0042395 A1 Feb. 12, 2015

(30) Foreign Application Priority Data

Aug. 6, 2013 (TW) ..... 102128111 A

(51) Int. Cl.
*G09G 3/22* (2006.01)

(52) U.S. Cl.
CPC ..... *G09G 3/22* (2013.01); *G09G 2310/0289* (2013.01); *G09G 2310/0297* (2013.01)

(58) Field of Classification Search
CPC ..... G09G 2310/0289; G09G 2310/0297; H04N 19/89; H04N 21/2383
See application file for complete search history.

(56) References Cited

U.S. PATENT DOCUMENTS

2010/0164929 A1 7/2010 Chen et al.

FOREIGN PATENT DOCUMENTS

| | | |
|---|---|---|
| TW | 200639478 | 11/2006 |
| TW | I361413 | 4/2012 |
| TW | I369663 | 8/2012 |

OTHER PUBLICATIONS

"Notice of Allowance of Taiwan Counterpart Application," issued on Jul. 14, 2015, p. 1-p. 4.

*Primary Examiner* — Amare Mengistu
*Assistant Examiner* — Shawna Stepp Jones
(74) *Attorney, Agent, or Firm* — Jianq Chyun IP Office

(57) ABSTRACT

A source driver and a method to reduce peak current of the source driver are provided. The source driver includes a latch circuit, a level shifter and a digital-to-analog converter (DAC) circuit. The latch circuit latches current bit-data. The latch circuit is coupled to an input terminal of the level shifter. The DAC circuit is coupled to an output terminal of the level shifter. When the current bit-data is not a complement of previous bit-data, the latch circuit selects and outputs the current bit-data to the input terminal of the level shifter, and the DAC circuit outputs a voltage corresponding to the output data of the level shifter. When the current bit-data is the complement of the previous bit-data, the latch circuit selects and outputs the previous bit-data to the input terminal of the level shifter, and the DAC circuit outputs a voltage corresponding to the current bit-data.

16 Claims, 16 Drawing Sheets

SOURCE DRIVER AND METHOD TO REDUCE PEAK CURRENT THEREIN

CROSS-REFERENCE TO RELATED APPLICATION

This application claims the priority benefit of Taiwan application serial no. 102128111, filed on Aug. 6, 2013. The entirety of the above-mentioned patent application is hereby incorporated by reference herein and made a part of this specification.

BACKGROUND

1. Technical Field

The invention relates to a source driver and a method for reducing peak current in the source driver.

2. Related Art

FIG. 1 is a circuit block schematic diagram of a conventional source driver (SD) 100. The source driver 100 is coupled between a timing controller 10 and a display panel 20. A power supply voltage VDDA can be supplied to the source driver 100. Under control of the timing controller 10, the source driver 100 can convert pixel data provided by the timing controller 10 into driving voltages, and drive the display panel 20 by using the driving voltages to display a corresponding image. The source driver 100 includes a data receiver 110, a latch 120, a digital-to-analog converter (DAC) 130 and an output buffer 140.

FIG. 2 is a signal timing schematic diagram of the source driver 100 of FIG. 1. Referring to FIG. 1 and FIG. 2, the latch 120 receives pixel data transmitted from the timing controller 10 through the data receiver 110, and latches the pixel data in corresponding channels. According to a timing of a latch signal LD, the latch 120 can output pixel data D1, D2, D3, . . . , Dx−1 and Dx latched in different channels to the DAC 130. The DAC 130 respectively converts the pixel data D1−Dx in different channels into corresponding analog grayscale voltages I1, I2, I3, Ix−1 and Ix according to a GAMMA voltage VG. The output buffer 140 respectively outputs corresponding driving voltages to different data lines Y1, Y2, Y3, . . . , Yx−1 and Yx of the display panel 20 according to the analog grayscale voltages I1-Ix in different channels.

As that shown in FIG. 2, since the latch 120 updates the new pixel data to an input terminal of the DAC 130 according to a rising time point of the latch signal LD in a parallel manner, when the new pixel data is a complement of the old pixel data, a power supply current I(VDDA) of the source driver 100 may produce a large instantaneous peak current. As that shown in FIG. 2, when the new (current) pixel data (for example, FF) is the complement of the old (previous) pixel data (for example, 00), the power supply current I(VDDS) of the source driver 100 may produce an instantaneous peak current shown by a dot line circle 200 in FIG. 2. The instantaneous peak current generally causes instantaneous drop of the voltage level of the power supply voltage VDDA, which influences a normal operation of the internal circuit. Besides, instantaneous drop of the voltage level of the power supply voltage VDDA also has an electromagnetic interference (EMI) effect on the system.

SUMMARY

The invention is directed to a source driver and a method for reducing peak current in the source driver, so as to decrease an instantaneous peak current.

The invention provides a source driver including a latch circuit, a level shifter and a digital-to-analog converter (DAC) circuit. The latch circuit latches at least one current bit-data. The latch circuit is coupled to an input terminal of the level shifter. The DAC circuit is coupled to an output terminal of the level shifter. When the at least one current bit-data is not a complement of at least one previous bit-data, the latch circuit selects and outputs the at least one current bit-data to the input terminal of the level shifter to replace the at least one previous bit-data, and the DAC circuit outputs a voltage corresponding to output data of the level shifter. When the at least one current bit-data is the complement of the at least one previous bit-data, the latch circuit selects and outputs the at least one previous bit-data to the input terminal of the level shifter, and the DAC circuit outputs a voltage corresponding to the at least one current bit-data.

The invention provides a method for reducing peak current of a source driver, which includes following steps. At least one current bit-data and at least one previous bit-data are compared. When the at least one current bit-data is not a complement of the at least one previous bit-data, the at least one current bit-data is selected and output to an input terminal of a level shifter of the source driver to replace the at least one previous bit-data, and a DAC circuit is used to convert output data of the level shifter to a corresponding voltage. When the at least one current bit-data is the complement of the at least one previous bit-data, the at least one previous bit-data is selected and output to the input terminal of the level shifter, and the DAC circuit is used to output a voltage corresponding to the at least one current bit-data.

According to the above description, the source driver and the method for reducing peak value therein determine whether the current bit-data is the complement of the previous bit-data. When the at least one current bit-data is the complement of the at least one previous bit-data, the at least one previous bit-data is selected and output to the input terminal of the level shifter, and the DAC circuit is used to output a voltage corresponding to the at least one current bit-data. Therefore, the level shifter and other components in the source driver are capable of decreasing the instantaneous peak current.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
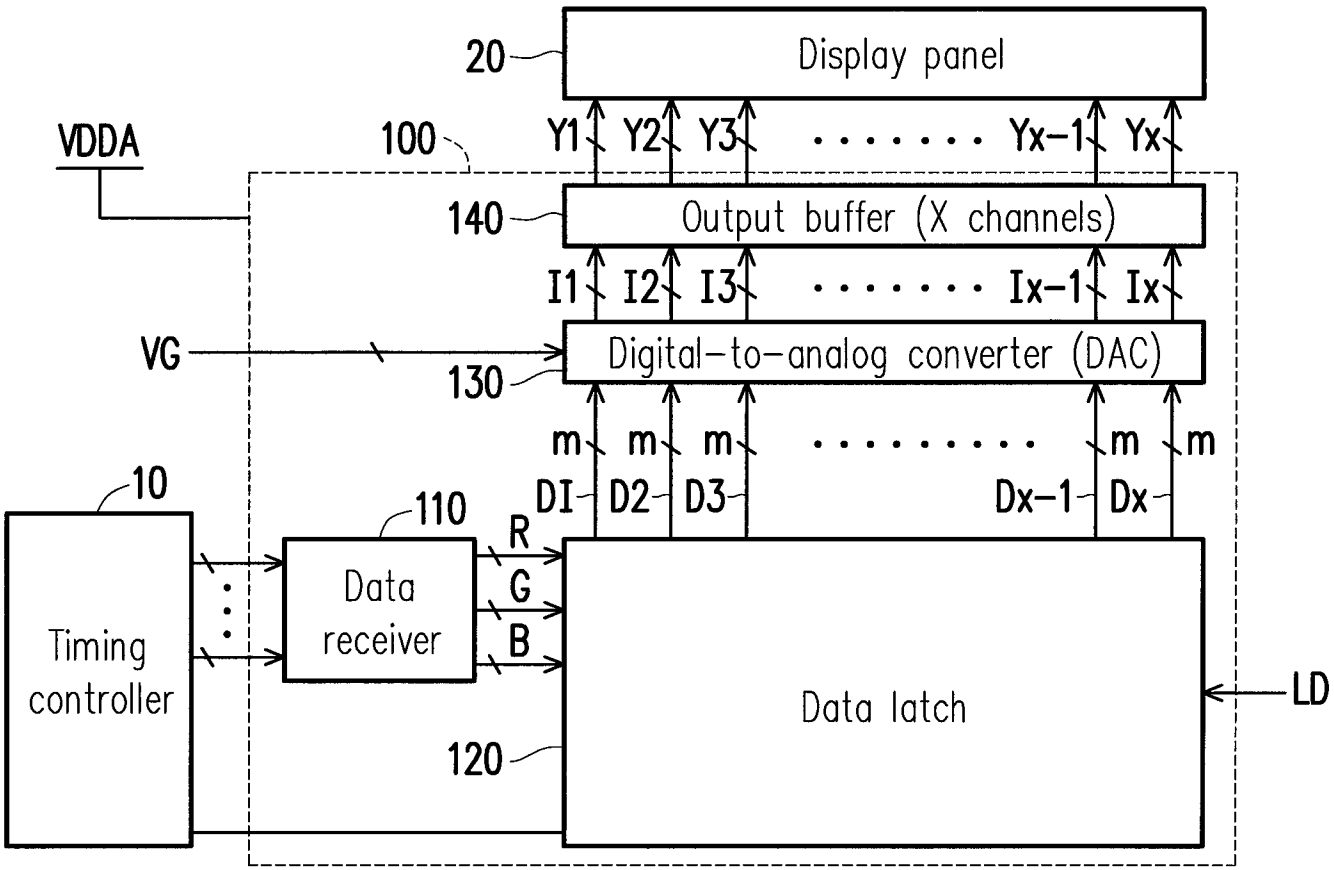
FIG. 1 (RELATED ART)
FIG. 1 is a circuit block schematic diagram of a conventional source driver.
Figure 2:
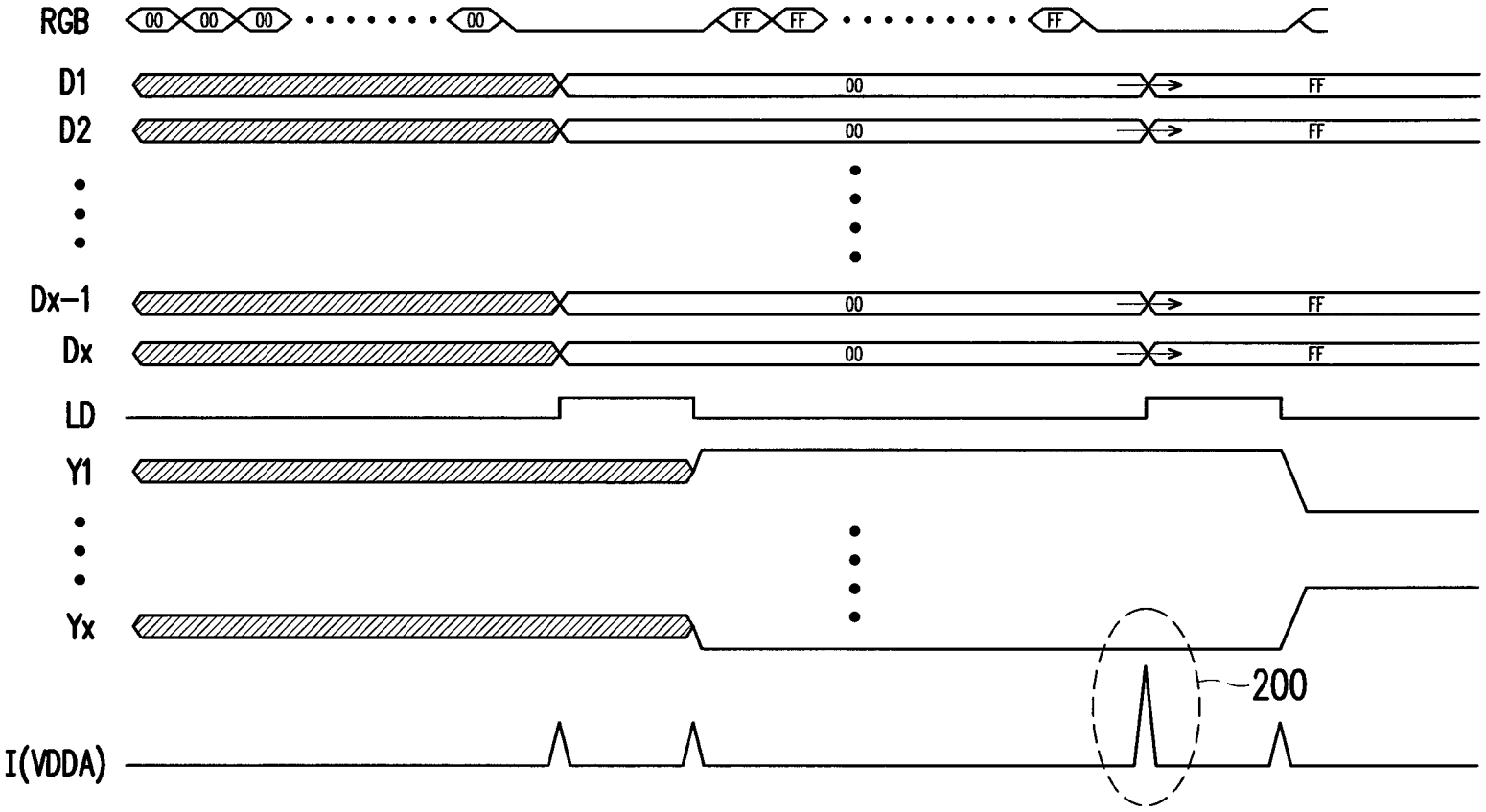
FIG. 2 (RELATED ART)
FIG. 2 is a signal timing schematic diagram of the source driver of FIG. 1.

A term "couple" used in the full text of the disclosure (including the claims) refers to any direct and indirect connections. For example, if a first device is described to be coupled to a second device, it is interpreted as that the first device is directly coupled to the second device, or the first device is indirectly coupled to the second device through other devices or connection means. Moreover, wherever possible, components/members/steps using the same referential numbers in the drawings and description refer to the same or like parts. Components/members/steps using the same referential numbers or using the same terms in different embodiments may cross-refer related descriptions.

Figure 3:
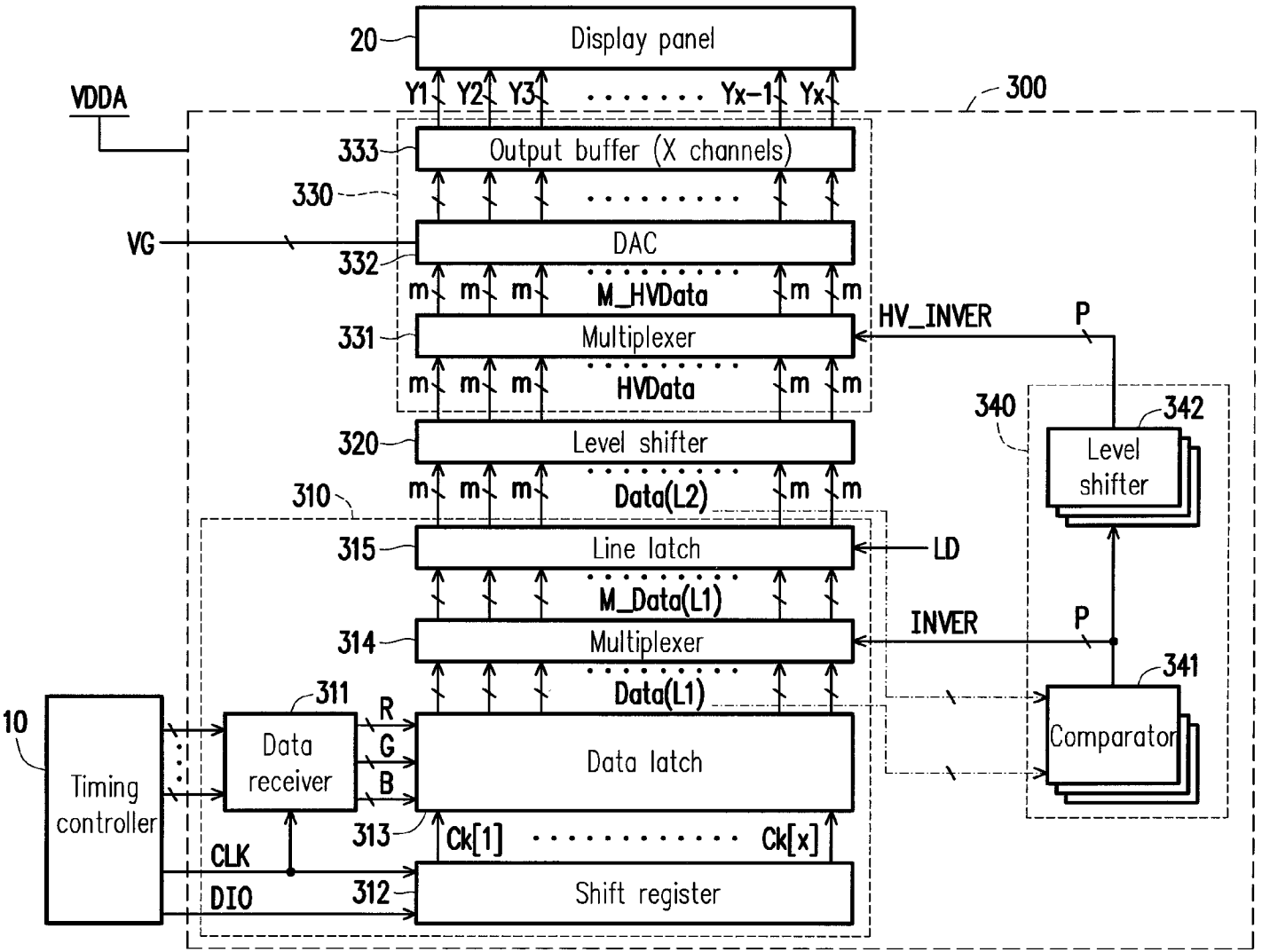
FIG. 3 is a circuit block schematic diagram of a source driver according to an embodiment of the invention.

FIG. 3 is a circuit block schematic diagram of a source driver 300 according to an embodiment of the invention. The source driver 300 is coupled between the timing controller 10 and the display panel 20. The display panel 200 can be a liquid crystal display panel or other flat panel display. Under control of the timing controller 10, the source driver 300 converts pixel data provided by the timing controller 10 into driving voltages, and use the driving voltages to drive data lines (or sources lines) of the display panel 20 to display a corresponding image.

The source driver 300 includes a latch circuit 310, a level shifter 320 and a digital-to-analog converter (DAC) circuit 330. The latch circuit 310 receives at least one current bit-data from the timing controller 10 and latches the same, and outputs the at least one current bit-data to an input terminal of the level shifter 320 to replace at least one previous bit-data. The at least one current bit-data can be a part of bits or all bits of pixel data in a single data channel, or can be a part of bits or all bits of pixel data in a plurality of (or even all of) data channels. The level shifter 320 changes a voltage level of the output data of the latch circuit 310, and outputs the voltage level-adjusted data to an input terminal of the DAC circuit 330. The DAC circuit 330 converts the output data (digital data) of the level shifter 320 into corresponding voltages (analog voltages), and outputs the corresponding voltages to the data lines (source lines) of the display panel to display a corresponding image.

In the present embodiment, implementation of the latch circuit 310 is not limited. For example, the latch circuit 310 of FIG. 3 includes a data receiver 311, a shift register 312, a data latch 313, a multiplexer 314 and a line latch 315. The shift register 312 receives a clock signal CLK and a line data start signal DIO from the timing controller 10. According to a timing of the clock signal CLK, the shift register 312 can respectively transmit pulses in the line data start signal DIO to different channels, i.e. outputs latch clocks Ck[1], . . . , Ck[x] of different phases to different channels of the data latch 313. In the embodiment of FIG. 3, the source driver 300 is assumed to have x channels.

Figure 4:
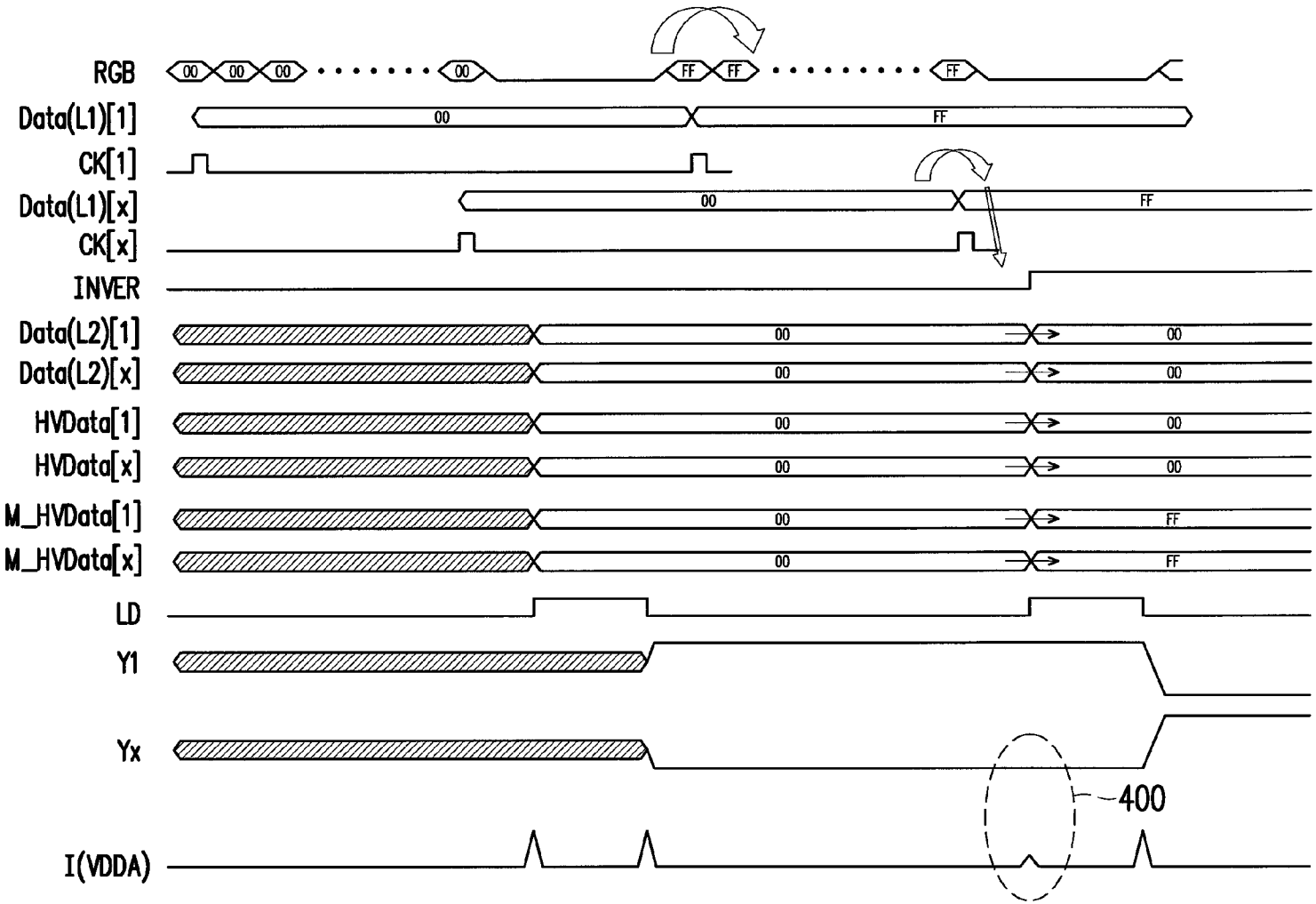
FIG. 4 is a signal timing schematic diagram of the source driver of FIG. 3 according to an embodiment of the invention.

FIG. 4 is a signal timing schematic diagram of the source driver 300 of FIG. 3 according to an embodiment of the invention. Referring to FIG. 3 and FIG. 4, the shift register 312 outputs the latch clocks Ck[1]-Ck[x] of different phases to the data latch 313. The data latch 313 receives pixel data R, G, B from the timing controller through the data receiver 311. According to timing of the latch clocks Ck[1]-Ck[x] of different channels, different pixel data transmitted from the timing controller 10 is latched to the corresponding channel of the data latch 313. An output terminal of the line latch 315 is coupled to an input terminal of the level shifter 320. The line latch 315 latches data at an input terminal of the line latch 315 according to a latch signal LD. The multiplexer 314 is coupled between an output terminal of the data latch 313 and the input terminal of the line latch 315. The multiplexer 314 selects to transmit the current bit-data output by the data latch 313 or a complement of the current bit-data to the input terminal of the line latch 315 according to a first control signal INVER.

For example, referring to FIG. 4, it is assumed that the pixel data R, G, B transmitted by the timing controller 10 during a previous period are all "00", the data latch 313 can latch the pixel data "00" of different channels in the corresponding channel according to the latch clocks Ck[1]-Ck[x]. For example, the data latch 313 latches "00" in a first channel according to the timing of the latch clock Ck[1], and outputs first channel pixel data Data(L1)[1] of pixel data Data(L1). Deducted by analogy, the data latch 313 latches "00" in an $x^{th}$ channel according to the timing of the latch clock Ck[x], and outputs $x^{th}$ channel pixel data Data(L1)[x] of the pixel data Data(L1). The line latch 315 can receive the output data of the data latch 313 through the multiplexer 314. For example, the line latch 315 latches the pixel data Data(L1) of the output terminal of the data latch 313 according to the latch signal LD, and outputs a latch content, i.e. outputs first channel pixel data Data(L2)[1], $x^{th}$ channel pixel data Data(L2)[x] of the pixel data Data(L2). After the previous period is ended, it is assumed that the pixel data transmitted by the timing controller 10 during a current period is "FF", the data latch 313 can latch the pixel data "FF" of different channels in the corresponding channel to replace the previous pixel data in the pervious period. For example, the data latch 313 latches "FF" in a first channel, and outputs the first channel pixel data Data(L1)[1] of the pixel data Data(L1), and latches "FF" in the $x^{th}$ channel and outputs $x^{th}$ channel pixel data Data(L1)[x] of the pixel data Data(L1).

Figure 5:
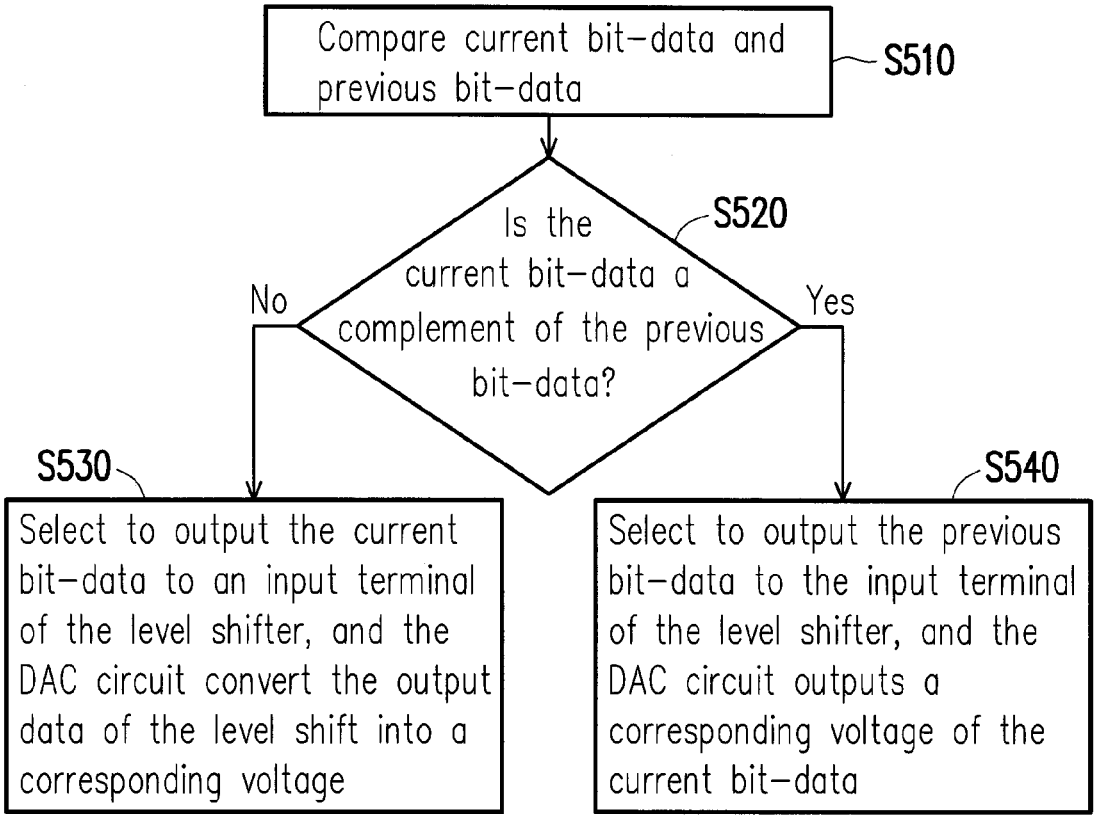
FIG. 5 is a flowchart illustrating a method for reducing peak current of a source driver according to an embodiment of the invention.

FIG. 5 is a flowchart illustrating a method for reducing peak current of a source driver according to an embodiment of the invention. In step S510, at least one current bit-data and at least one previous bit-data are compared. Implementation of the step S510 of the present embodiment is not limited. For example, in other embodiments, a front stage circuit of the source driver 300 (for example, the timing controller 10 or other circuit) may execute the step S510, and correspondingly control the latch circuit 310 and the DAC circuit 330 (referring to related descriptions of FIG. 8). In the present embodiment, the source driver 300 shown in FIG. 3 further includes a comparison circuit 340. The comparison circuit 340 is coupled to the latch circuit 310 and the DAC circuit 330. The comparison circuit 340 may execute the step S510 to compare the current bit-data and the previous bit-data.

When the current bit-data is not a complement of the previous bit-data, the comparison circuit 340 controls the latch circuit 310 to select and output the current bit-data to the input terminal of the level shifter 320, and the comparison circuit 340 controls the DAC circuit 330 to output a corresponding voltage of the output data of the level shifter 320. When the current bit-data is the complement of the previous bit-data, the comparison circuit 340 controls the latch circuit 310 to select and output the previous bit-data to the input terminal of the level shifter 320, and the comparison circuit 340 controls the DAC circuit 330 to output a corresponding voltage of the current bit-data.

In the present embodiment, the comparison circuit 340 includes a comparator 341 and a level shifter 342. The comparator 341 is coupled to the latch circuit 310. The comparator 341 executes the step S510 to compare the current bit-data and the previous bit-data, and correspondingly outputs the first control signal INVER to the latch circuit 310 according to a comparison result, so as to control the latch circuit 310 to select and output the current bit-data or the previous bit-data to the input terminal of the level shifter 320. The level shifter 342 is coupled between the comparator 341 and the DAC circuit 330. The level shifter 342 converts the first control signal INVER into a second control signal HV_INVER and outputs the same to the DAC circuit 330, so as to control the DAC circuit 330 to output the corresponding voltage of the output data of the level shifter 320, or control the DAC circuit 330 to output the corresponding voltage of the current bit-data.

A relationship between the bit-data and the pixel data can be determined according to design requirement for an actual product. For example, in some embodiments, the bit-data can be a part of bits or all bits of pixel data in a single data channel. Namely, the source driver 300 can be configured with x comparators 341 and x level shifters 342. Each of the comparators 341 receives a part of bits or all bits of pixel data of a corresponding single data channel in the pixel data Data(L1) from the data latch 313 to serve as the current bit-data, and each of the comparators 341 receives a part of bits or all bits of pixel data of a corresponding single data channel in the pixel data Data(L2) from the line latch 315 to serve as the previous bit-data. In some other embodiments, the bit-data can be a part of bits or all bits of pixel data in a plurality of (or even all of) data channels. For example, the x channels shown in FIG. 3 are grouped into P (i.e. x/N) channel groups in a manner of taking N channels as a group. Namely, the source driver 300 can be configured with P comparators 341 and P level shifters 342. Each of the comparators 341 receives a part of bits or all bits of pixel data of N corresponding channels in the pixel data Data(L1) from the data latch 313 to serve as the current bit-data, and each of the comparators 341 receives a part of bits or all bits of pixel data of N corresponding channels in the pixel data Data(L2) from the line latch 315 to serve as the previous bit-data.

Implementation of the DAC circuit 330 is not limited by the invention. For example, the DAC circuit 330 in the embodiment of FIG. 3 includes a multiplexer 331, a DAC 332 and an output buffer 333. The multiplexer 331 is coupled between the output terminal of the level shifter 320 and an input terminal of the DAC 332. The level shifter 342 is coupled between a control terminal of the multiplexer 331 and an output terminal of the comparator 341. The level shifter 342 changes a voltage level of the first control signal INVER, and outputs the voltage level-adjusted control signal (i.e. the second control signal HV_INVER) to the control terminal of the multiplexer 331. The multiplexer 331 selects to transmit the output of the level shifter 320 to an input terminal of the DAC 332 according to the second control signal HV_INVER, or selects to transmit a complement of the output of the level shifter 320 to the input terminal of the DAC 332. The DAC 332 respectively converts the pixel data of different channels into corresponding analog grayscale voltages according to the GAMMA voltage VG. The output buffer 333 is coupled between the output terminal of the DAC 332 and data lines Y1-Yx of the display panel 20. The output buffer 333 respectively outputs corresponding diving voltages to the data lines Y1-Yx of the display panel 20 according to the analogy voltages in different channels of the DAC 332.

The comparator 341 executes a step S520 to determine whether the current bit-data is a complement of the previous bit-data, and correspondingly controls the latch circuit 310 and the DAC circuit 330. When the current bit-data is not the complement of the previous bit-data, the comparator 341 executes a step S530. When the current bit-data is the complement of the previous bit-data, the comparator 341 executes a step S540.

When the current bit-data is not the complement of the previous bit-data, in the step S530, the comparator 341 controls the latch circuit 310 through the first control signal INVER to select the at least one current bit-data (for example, the pixel data Data(L1) of the data latch 313) for outputting to the input terminal of the level shifter 320 to replace the previous bit-data, and controls the DAC circuit 330 through the second control signal HV_INVER to convert the output data of the level shifter 320 to the corresponding voltages for outputting to the display panel 20. For example, when the pixel data Data(L1) of the data latch 313 is not the complement of the pixel data Data(L2) of the line latch 315, the multiplexer 314 selects the pixel data Data(L1) to serve as pixel data M_Data(L1) for outputting to the input terminal of the line latch 315 according to the first control signal INVER, and the multiplexer 331 selects the pixel data HVData output by the level shifter 320 to serve as pixel data M_HVData for outputting to the input terminal of the DAC 332 according to the second control signal HV_INVER.

When the at least one current bit-data is the complement of the at least one previous bit-data, in the step S540, the comparator 341 controls the latch circuit 310 through the first control signal INVER to select the at least one previous bit-data (for example, the complementation of the pixel data Data(L1) of the data latch 313) for outputting to the input terminal of the level shifter 320, and controls the DAC circuit 330 through the second control signal HV_INVER to output the corresponding voltage of the at least one current bit-data (for example, the pixel data Data(L1) of the data latch 313). For example, when the pixel data Data(L1) of the data latch 313 is the complement of the pixel data Data(L2) of the line latch 315, the multiplexer 314 selects the pixel data Data(L1) to serve as the pixel data M_Data(L1) for outputting to the input terminal of the line latch 315 according to the first control signal INVER, and the multiplexer 331 selects the complement of the pixel data HVData of the level shifter 320 to serve as pixel data M_HVData for outputting to the input terminal of the DAC 332 according to the second control signal HV_INVER.

Taking FIG. 4 as an example, when the current bit-data (for example, Data(L1)[1]-Data(L1)[x]) is "FF", and the previous bit-data (for example, Data(L2)[1]-Data(L2)[x]) is "00", the current bit-data is the complement of the previous bit-data. When the current bit-data is the complement of the previous bit-data, the multiplexer 314 selects the complement of the current bit-data (i.e. "00") to serve as the pixel data M_Data (L1) for outputting to the input terminal of the line latch 315. Therefore, the line latch 315 latches the complement of the current bit-data (i.e. "00"), and outputs "00" as the pixel data Data(L2). The pixel data HVData[1]-HVData[x] of the level shifter 320 are maintained to logic value "00" without transition. Therefore, when the new (current) pixel data (for example, "FF") is the complement of the old (previous) pixel data (for example, "00"), an instantaneous peak current (shown by a dot line circle 400 of FIG. 4) of a power supply current I(VDDS) of the source driver 300 is greatly decreased.

However, when the current bit-data is the complement of the previous bit-data, the pixel data HVData of the level shifter 320 is not the correct logic value. Therefore, when the current bit-data is the complement of the previous bit-data, the multiplexer 331 selects the complement of the pixel data HVData of the level shifter 320 to serve as pixel data M_HVData for outputting to the input terminal of the DAC 332 according to the second control signal HV_INVER. As that shown in FIG. 4, the multiplexer 331 outputs the pixel data M_HVData[1]-M_HVData[x] with the logic value of "FF" to the input terminal of the DAC 332, such that the DAC 332 can output correct analog voltages.

Figure 6:
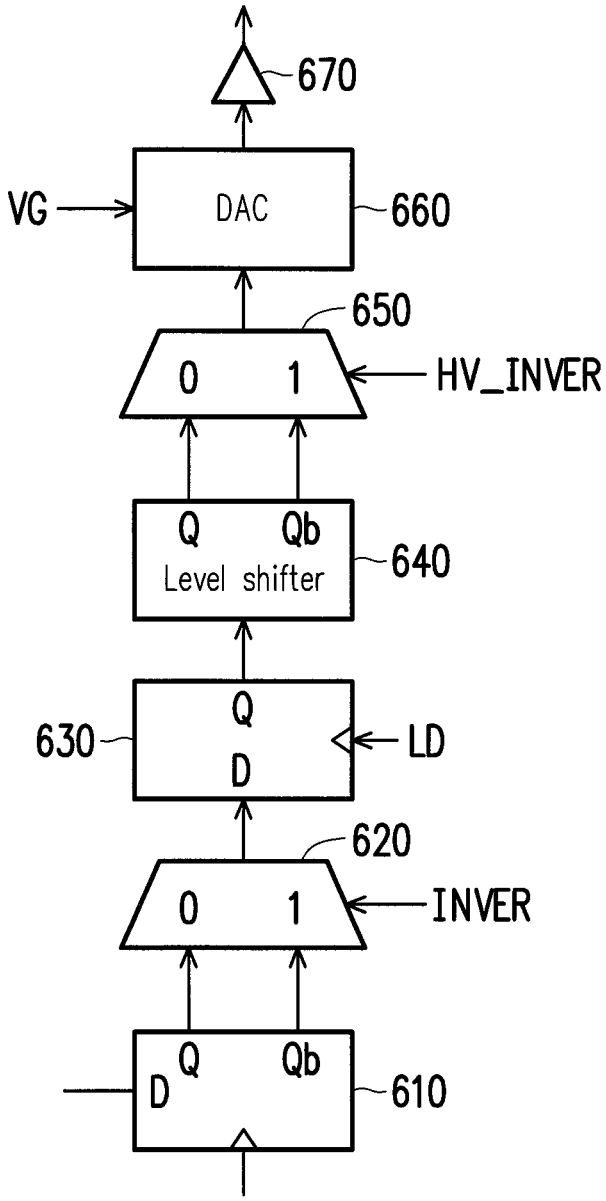
FIG. 6 is a schematic diagram of an implementation of a multiplexer of FIG. 3 according to an embodiment of the invention.

FIG. 6 is a schematic diagram of an implementation of the multiplexer of FIG. 3 according to an embodiment of the invention. The circuit shown in FIG. 6 is a schematic diagram of a single-bit circuit. Those skilled in the art may deduce the multi-bit circuit according to the instruction of the present embodiment. The circuit shown in FIG. 6 can be regarded as a circuit of one of a plurality of bits in multiple channels of FIG. 3. A data latch 610, a multiplexer 620, a line latch 630, a level shifter 640, a multiplexer 650, a DAC 660 and an output buffer 670 of FIG. 6 are similar to the data latch 313, the multiplexer 314, the line latch 315, the level shifter 320, the multiplexer 331, the DAC 332 and the output buffer 333 of FIG. 3.

Referring to FIG. 6, a shift register (not shown, referring to the shift register 312 of FIG. 3) provides a latch clock to a trigger terminal of the data latch 610. The data latch 610 receives pixel data transmitted from a timing controller (not shown, referring to the timing controller 10 of FIG. 3) through a data terminal D. According to the timing of the latch clock, the pixel data at the data terminal D is latched in the data latch 610. A first selection terminal and a second selection terminal of the multiplexer 620 are respectively coupled to a non-inverted output terminal Q and an inverted output terminal Qb of the data latch 610. A signal of the non-inverted output Q and a signal of the inverted output terminal Qb are inverted to each other (i.e. complements of each other). The multiplexer 620 selects to output the current bit-data output by the non-inverted output terminal Q of the data latch 610 to an input terminal D of the line latch 630 according to the first control signal INVER, or selects to output data (the complement of the current bit-data) output by the inverted output terminal Qb of the data latch 610 to the input terminal D of the line latch 630. The line latch 630 latches the pixel data of the input terminal D according to the latch signal LD, and outputs the latch content to the level shifter 640 through an output terminal Q.

The level shifter 640 changes a voltage level of the output terminal Q of the line latch 630, and outputs the voltage level-adjusted data to the multiplexer 650. A first selection terminal and a second selection terminal of the multiplexer 650 are respectively coupled to a non-inverted output terminal Q and an inverted output terminal Qb of the level shifter 640. A signal of the non-inverted output Q and a signal of the inverted output terminal Qb are inverted to each other (i.e. complements of each other). The multiplexer 650 selects to output data output by the non-inverted output terminal Q of the data latch 640 to an input terminal of the DAC 660 according to the second control signal HV_INVER, or selects to output data output by the inverted output terminal Qb of the data latch 640 to the input terminal of the DAC 660. The DAC 660 converts digital data output by the multiplexer 650 into corresponding analog grayscale voltages, and outputs the analog grayscale voltages to an input terminal of the output buffer 670. The output buffer 670 can output corresponding driving voltages to the data lines of the display panel (not shown, referring to the display panel 20 of FIG. 3) according to the analog grayscale voltages output by the DAC 660.

Figure 7:
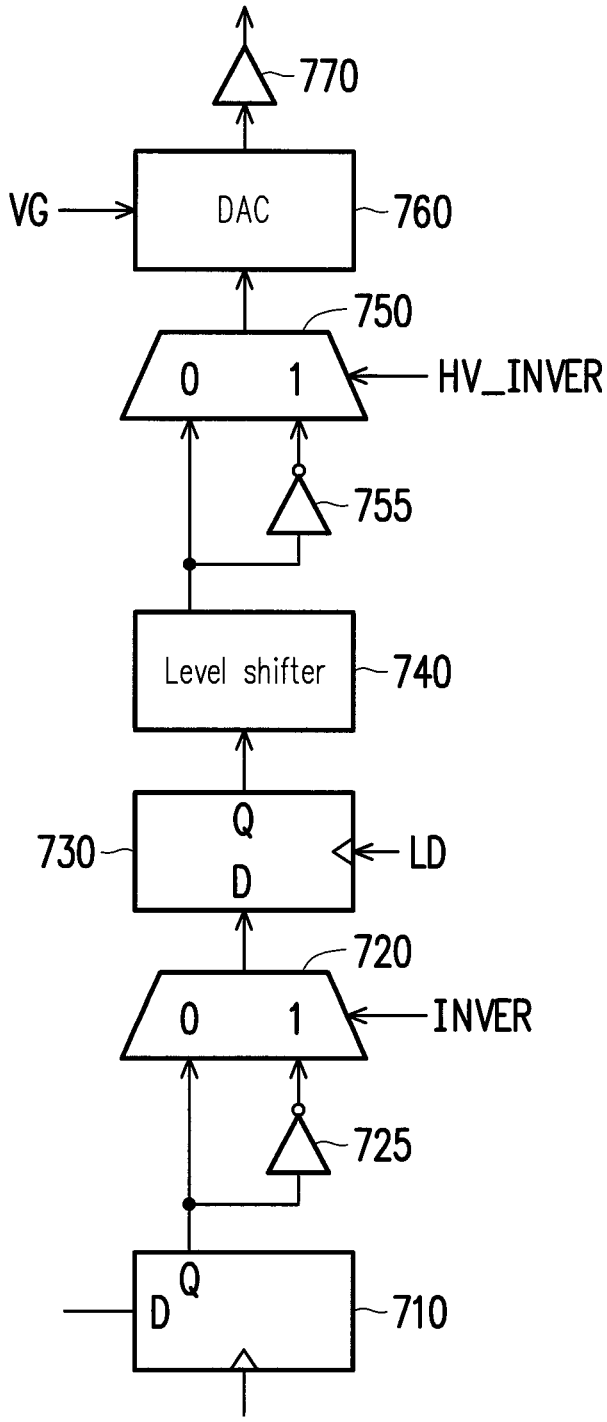
FIG. 7 is a schematic diagram of an implementation of the multiplexer of FIG. 3 according to another embodiment of the invention.

FIG. 7 is a schematic diagram of an implementation of the multiplexer of FIG. 3 according to another embodiment of the invention. The circuit shown in FIG. 7 is a schematic diagram of a single-bit circuit. Those skilled in the art may deduce the multi-bit circuit according to the instruction of the present embodiment. The circuit shown in FIG. 7 can be regarded as a circuit of one of a plurality of bits in multiple channels of FIG. 3. A data latch 710, a multiplexer 720, a line latch 730, a level shifter 740, a multiplexer 750, a DAC 760 and an output buffer 770 of FIG. 7 are similar to the data latch 313, the multiplexer 314, the line latch 315, the level shifter 320, the multiplexer 331, the DAC 332 and the output buffer 333 of FIG. 3.

Descriptions of the data latch 710, the multiplexer 720, the line latch 730, the level shifter 740, the multiplexer 750, the DAC 760 and the output buffer 770 of FIG. 7 can be deduced by referring to related descriptions of the data latch 610, the multiplexer 620, the line latch 630, the level shifter 640, the multiplexer 650, the DAC 660 and the output buffer 670 of FIG. 6. Different to the embodiment of FIG. 6, the embodiment of FIG. 7 further includes a NOT gate 725 and a NOT gate 755.

Referring to FIG. 7, an input terminal of the NOT gate 725 is coupled to the output terminal Q of the data latch 710. The first selection terminal of the multiplexer 720 is coupled to the output terminal Q of the data latch 710, and the second selection terminal of the multiplexer 720 is coupled to an output terminal of the NOT gate 725. The NOT gate 725 may provide an inverted signal (i.e. a complement) of a signal of the output terminal Q of the data latch 710. The multiplexer 720 selects to output the current bit-data output by the output terminal Q of the data latch 710 to an input terminal D of the line latch 730 according to the first control signal INVER, or selects to output the complement of the current bit-data to the input terminal D of the line latch 730.

An input terminal of the NOT gate 755 is coupled to the output terminal of the level shifter 740. The first selection terminal of the multiplexer 750 is coupled to the output terminal of the level shifter 740, and the second selection terminal of the multiplexer 750 is coupled to an output terminal of the NOT gate 755. The NOT gate 755 may provide an inverted signal (i.e. a complement) of the output signal of the level shifter 740. The multiplexer 750 selects to output the data output by the level shifter 740 to an input terminal of the DAC 760 according to the second control signal HV_INVER, or selects to output the complement of the output data of the level shifter 740 to the input terminal of the DAC 760.

Figure 8:
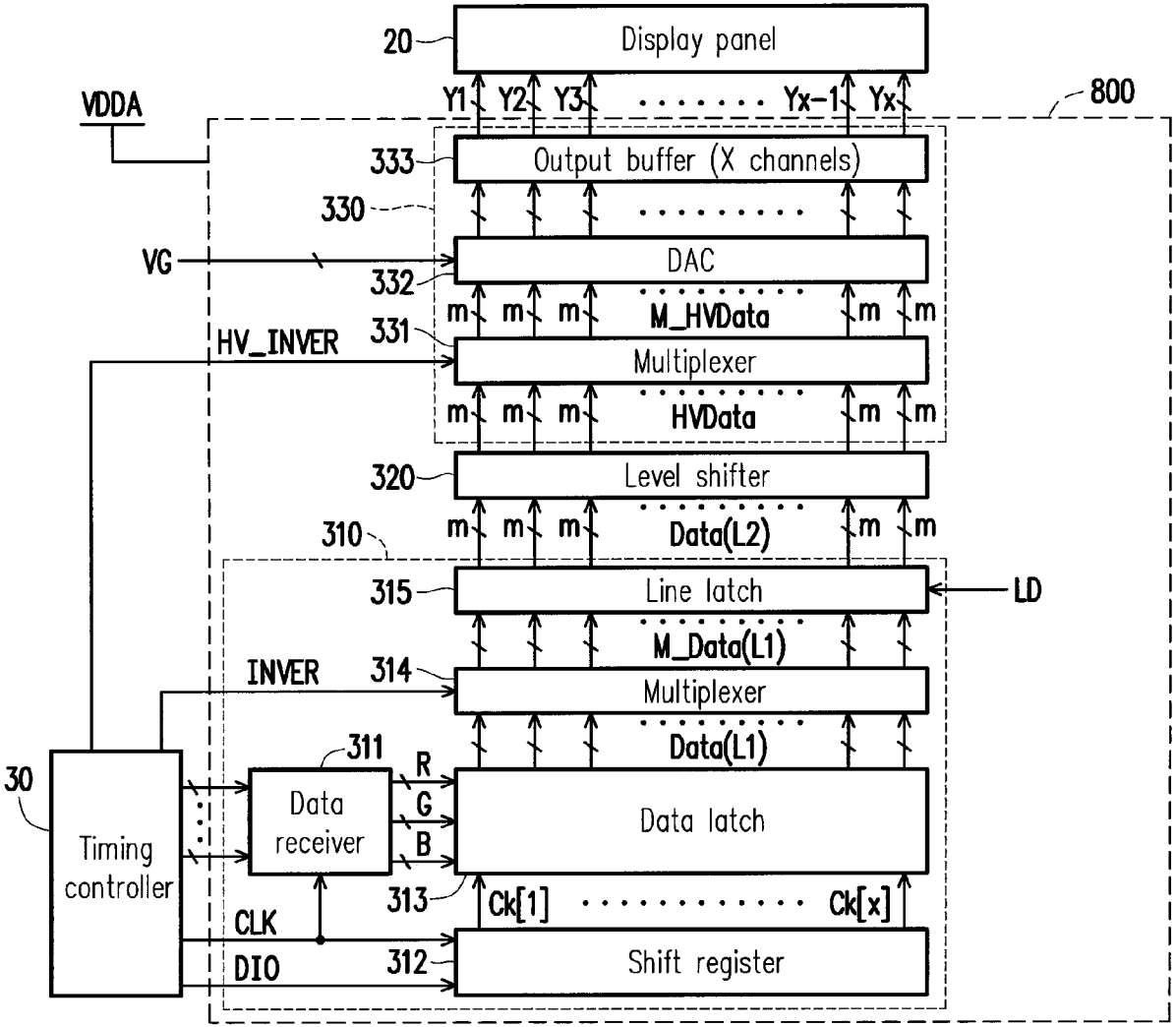
FIG. 8 is a circuit block schematic diagram of a source driver according to still another embodiment of the invention.

FIG. 8 is a circuit block schematic diagram of a source driver according to still another embodiment of the invention. Descriptions of the source driver 800 of FIG. 8 and the internal components thereof can be deduced by referring to related descriptions of the source driver 300 of FIG. 3. Different to the embodiment of FIG. 3, the multiplexer 314 of the latch circuit 310 and the multiplexer 331 of the DAC circuit 330 are controlled by the timing controller 30. The timing controller 30 can compare the current bit-data and the previous bit-data. When the current bit-data is not the complement of the previous bit-data, the timing controller 30 controls the multiplexer 314 of the latch circuit 310 to select and output the current bit-data to the line latch 315, and the timing controller 30 controls the multiplexer 331 of the DAC circuit 330 to output the output data of the level shifter 320 to the DAC 332. When the current bit-data is the complement of the previous bit-data, the timing controller 30 controls the multiplexer 314 of the latch circuit 310 to select and output the previous bit-data (i.e. the complement of the current bit-data) to the line latch 315, and the timing controller 30 controls the multiplexer 331 of the DAC circuit 330 to output the current bit-data (i.e. a complement of the output data of the level shifter 320) to the DAC 332.

Figure 9:
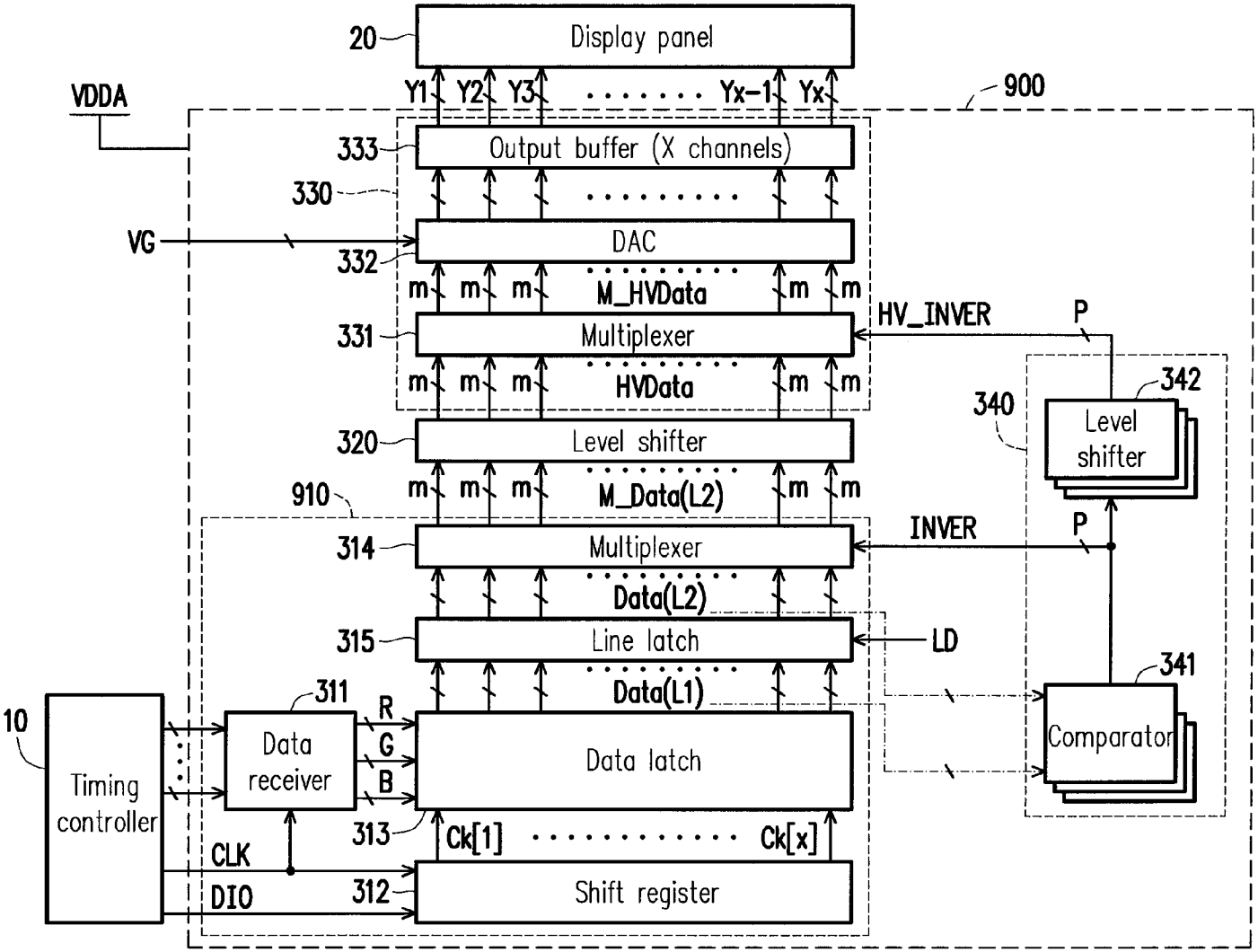
FIG. 9 is a circuit block schematic diagram of a source driver according to still another embodiment of the invention.

FIG. 9 is a circuit block schematic diagram of a source driver according to still another embodiment of the invention. The source driver 900 is coupled between the timing controller 10 and the display panel 20. Under control of the timing controller 10, the source driver 900 can convert the pixel data provided by the timing controller 10 into driving voltages, and supply the driving voltages to drive the data lines (or source lines) of the display panel 20 to display a corresponding image. The source driver 900 includes a latch circuit 910, the level shifter 320 and the DAC circuit 330. The latch circuit 910 receives at least one current bit-data from the timing controller 10 and latches the same, and outputs the at least one current bit-data to the input terminal of the level shifter 320 to replace at least one previous bit-data. The current bit-data can be a part of bits or all bits of pixel data in a single data channel, or can be a part of bits or all bits of pixel data in a plurality of (or even all of) data channels. Descriptions of the source driver 900 of FIG. 9 and internal components thereof can be deduced by referring to related description of the source driver 300 of FIG. 3 and related description of the source driver 800 of FIG. 8.

The latch circuit 910 of FIG. 9 includes the data receiver 311, the shift register 312, the data latch 313, the multiplexer 314 and the line latch 315. Different to the embodiment of FIG. 3, in the embodiment of FIG. 9, the multiplexer 314 is coupled between the line latch 315 and the level shifter 320.

Figure 10:
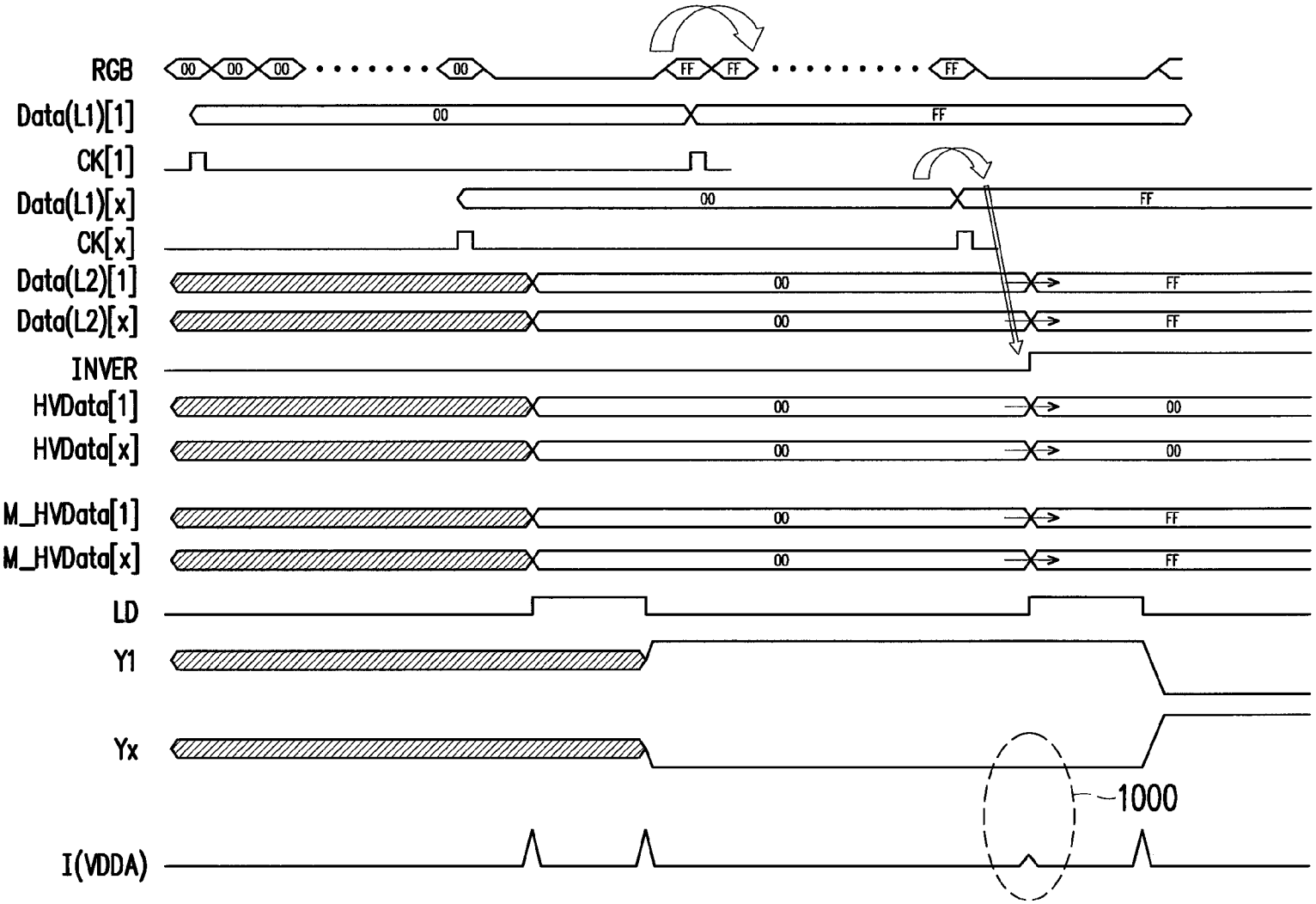
FIG. 10 is a signal timing schematic diagram of the source driver of FIG. 9 according to an embodiment of the invention.

FIG. 10 is a signal timing schematic diagram of the source driver 900 of FIG. 9 according to an embodiment of the invention. Referring to FIG. 9 and FIG. 10, the data latch 313 receives pixel data R, G, B transmitted from the timing controller 10 through the data receiver 311. According to timing of the latch clocks Ck[1]-Ck[x] of different channels, the different pixel data transmitted from the timing controller 10 is latched in the corresponding channel of the data latch 313. The input terminal of the line latch 315 is coupled to the output terminal of the data latch 313, where the line latch 315 latches data at the input terminal of the line latch 315 according to the latch signal LD. The multiplexer 314 is coupled between the output terminal of the line latch 315 and the input terminal of the level shifter 320. The multiplexer 314 selects to transmit the current bit-data output by the line latch 315 to the input terminal of the level shifter 320 according to the first control signal INVER, or selects to transmit the complement of the current bit-data to the input terminal of the level shifter 320.

For example, referring to FIG. 10, it is assumed that the pixel data R, G, B transmitted by the timing controller 10 during a previous period are all "00", the data latch 313 can latch the pixel data "00" of different channels in the corresponding channel according to the latch clocks Ck[1]-Ck[x]. For example, the data latch 313 latches "00" in a first channel according to the timing of the latch clock Ck[1], and outputs the first channel pixel data Data(L1)[1] of the pixel data Data(L1). Deducted by analogy, the data latch 313 latches "00" in an $x^{th}$ channel according to the timing of the latch clock Ck[x], and outputs $x^{th}$ channel pixel data Data(L1)[x] of the pixel data Data(L1). The line latch 315 can latch the pixel data Data(L1) output by the data latch 313 according to the latch signal LD. For example, the line latch 315 latches the pixel data Data(L1) of the output terminal of the data latch 313 according to the latch signal LD, and outputs a latch content, i.e. outputs first channel pixel data Data(L2)[1], . . . , $x^{th}$ channel pixel data Data(L2)[x] of the pixel data Data(L2). After the previous period is ended, it is assumed that the pixel data transmitted by the timing controller 10 during a current period is "FF", the data latch 313 can latch the pixel data "FF" of different channels in the corresponding channel to replace the previous pixel data during the pervious period. For example, the data latch 313 latches "FF" in a first channel, and outputs the first channel pixel data Data(L1)[1] of the pixel data Data(L1), and latches "FF" in the $x^{th}$ channel and outputs $x^{th}$ channel pixel data Data(L1)[x] of the pixel data Data(L1). According to the latch signal LD, the line latch 315 latches the pixel data Data(L1) with the logic value of "FF", and outputs the pixel data Data(L2) with the logic value of "FF", for example, the first channel pixel data Data(L2)[1] and the $x^{th}$ channel pixel data Data(L2)[x] shown in FIG. 10.

The comparator 341 of the comparison circuit 340 compares the current bit-data (for example, the pixel data Data (L1) output by the data latch 313) with the previous bit-data (for example, the pixel data Data(L2) output by the line latch 315), and outputs the first control signal INVER to the multiplexer 314 of the latch circuit 910 according to a comparison result. The level shifter 342 converts the first control signal INVER into the second control signal HV_INVER and outputs the same to the multiplexer 331 of the DAC circuit 330. When the current bit-data is not the complement of the previous bit-data, the comparator 341 controls the multiplexer 314 of the latch circuit 910 through the first control signal INVER, and the multiplexer 314 selects to output the pixel data Data(L2) output by the line latch 315 to the input terminal of the level shifter 320, and the comparator 341 controls the multiplexer 331 of the DAC circuit 330 through the second control signal HV_INVER, and the multiplexer 331 selects to output the output data of the level shifter 320 to the DAC 332. When the current bit-data is the complement of the previous bit-data, the comparator 341 controls the multiplexer 314 of the latch circuit 910 through the first control signal INVER, and the multiplexer 314 selects to output the complement of the pixel data Data(L2) output by the line latch 315 to the input terminal of the level shifter 320, and the comparator 341 controls the multiplexer 331 of the DAC circuit 330 through the second control signal HV_INVER, and the multiplexer 331 selects to output the complement of the output data of the level shifter 320 to the DAC 332.

Taking FIG. 10 as an example, when the current bit-data (for example, Data(L1)[1]-Data(L1)[x]) is "FF", and the previous bit-data (for example, Data(L2)[1]-Data(L2)[x]) is "00", the current bit-data is the complement of the previous bit-data. When the current bit-data is the complement of the previous bit-data, the multiplexer 314 selects the complement of the current bit-data (i.e. "00") to serve as the pixel data M_Data(L2) for outputting to the input terminal of the level shifter 320. Therefore, the pixel data HVData[1]-HVData[x]

of the level shifter 320 are maintained to logic value "00" without transition. Therefore, when the new (current) pixel data (for example, "FF") is the complement of the old (previous) pixel data (for example, "00"), an instantaneous peak current (shown by a dot line circle 1000 of FIG. 10) of a power supply current I(VDDS) of the source driver 900 is greatly decreased.

Figure 11:
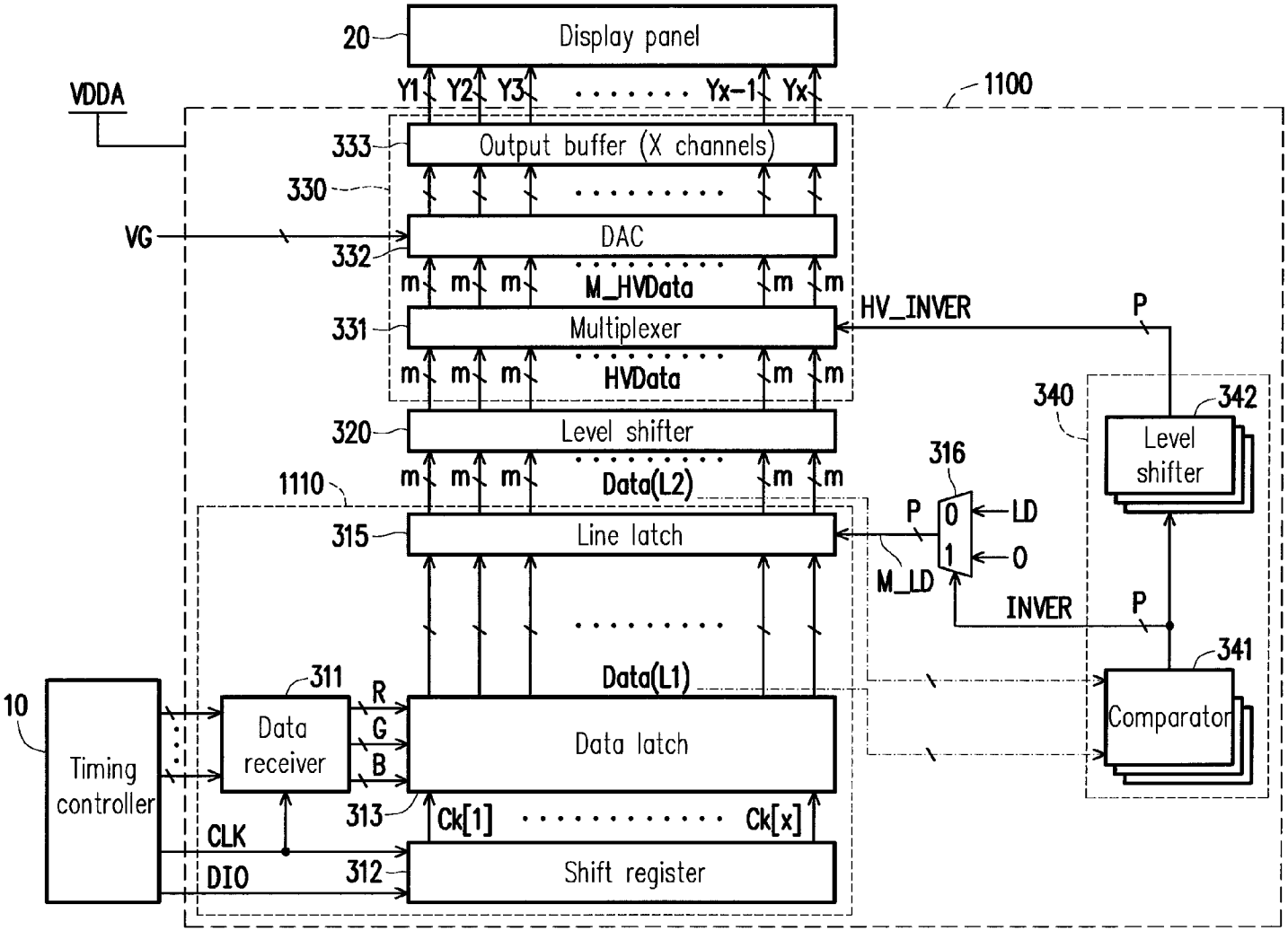
FIG. 11 is a circuit block schematic diagram of a source driver according to still another embodiment of the invention.

FIG. 11 is a circuit block schematic diagram of a source driver 1100 according to still another embodiment of the invention. The source driver 1100 is coupled between the timing controller 10 and the display panel 20. Under control of the timing controller 10, the source driver 1100 may convert the pixel data provided by the timing controller 10 into driving voltages, and use the driving voltages to drive the data lines (source lines) of the display panel 20 to display the corresponding image. The source driver 1100 includes a latch circuit 1110, the level shifter 320 and the DAC circuit 330. The latch circuit 1110 receives at least one current bit-data from the timing controller 10 and latches the same, and outputs the at least one current bit-data to the input terminal of the level shifter 320 to replace at least one previous bit-data. The current bit-data can be a part of bits or all bits of pixel data in a single data channel, or can be a part of bits or all bits of pixel data in a plurality of (or even all of) data channels. Descriptions of the source driver 1100 of FIG. 11 and internal components thereof can be deduced by referring to related description of the source driver 300 of FIG. 3 or related description of the source driver 800 of FIG. 8.

The latch circuit 1110 of FIG. 11 includes the data receiver 311, the shift register 312, the data latch 313, the line latch 315 and the multiplexer 316. Different to the embodiment of FIG. 3, in the embodiment of FIG. 11, the multiplexer coupled between the data latch 313 and the line latch 315 is omitted, and the multiplexer 316 is configured between a trigger terminal of the line latch 315 and the latch signal LD.

Figure 12:
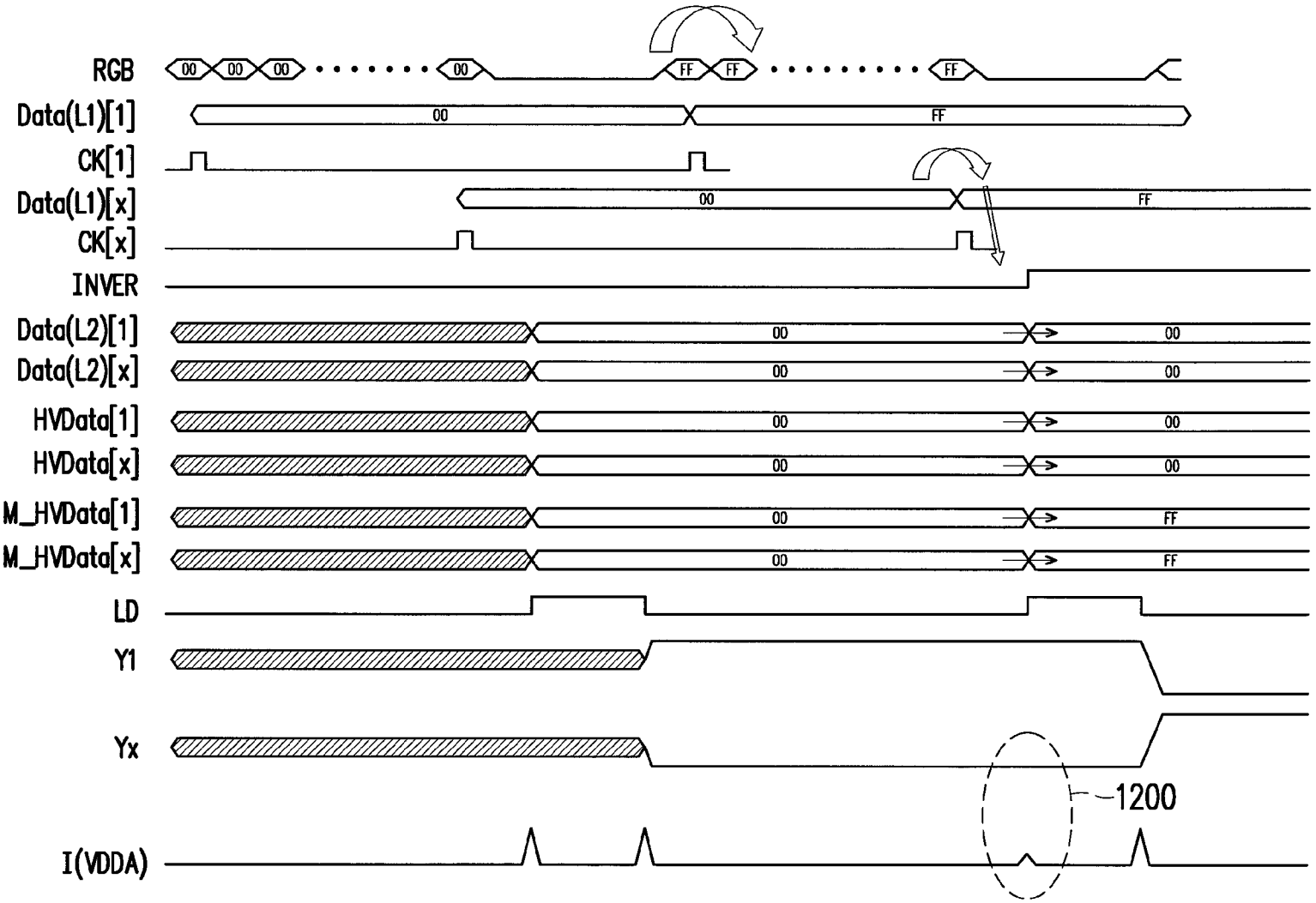
FIG. 12 is a signal timing schematic diagram of the source driver of FIG. 11 according to an embodiment of the invention.

FIG. 12 is a signal timing schematic diagram of the source driver 1100 of FIG. 11 according to an embodiment of the invention. Referring to FIG. 11 and FIG. 12, the data latch 313 receives pixel data R, G, B transmitted from the timing controller 10 through the data receiver 311. According to timing of the latch clocks Ck[1]-Ck[x] of different channels, the different pixel data transmitted from the timing controller 10 is latched in the corresponding channel of the data latch 313. The input terminal of the line latch 315 is coupled to the output terminal of the data latch 313, and the output terminal of the line latch 315 is coupled to the input terminal of the level shifter 320. The line latch 315 latches data at the input terminal of the line latch 315 according to a signal at the trigger terminal. A common terminal of the multiplexer 316 is coupled to the trigger terminal of the line latch 315 for providing a signal M_LD. The multiplexer 316 selects the latch signal LD as the signal M_LD for transmitting to the trigger terminal of the line latch 315 according to the first control signal INVER, or selects a disable signal (having a fixed logic value, for example, "0", "1" or other logic state) as the signal M_LD for transmitting to the trigger terminal of the line latch 315.

For example, referring to FIG. 12, it is assumed that the pixel data R, G, B transmitted by the timing controller 10 during a previous period are all "00", the data latch 313 can latch the pixel data "00" of different channels in the corresponding channel according to the latch clocks Ck[1]-Ck[x]. For example, the data latch 313 latches "00" in a first channel according to the timing of the latch clock Ck[1], and outputs the first channel pixel data Data(L1)[1] of the pixel data Data(L1). Deducted by analogy, the data latch 313 latches "00" in an $x^{th}$ channel according to the timing of the latch clock Ck[x], and outputs $x^{th}$ channel pixel data Data(L1)[x] of the pixel data Data(L1). The comparator 341 of the comparison circuit 340 compares the current bit-data (for example, the pixel data Data(L1) output by the data latch 313) with the previous bit-data (for example, the pixel data Data(L2) output by the line latch 315), and outputs the first control signal INVER to the multiplexer 316 of the latch circuit 1110 according to a comparison result. The level shifter 342 converts the first control signal INVER into the second control signal HV_INVER and outputs the same to the multiplexer 331 of the DAC circuit 330.

The line latch 315 determines whether to latch the pixel data Data(L1) output by the data latch 313 according to a signal at the trigger terminal thereof. For example, when the latch signal LD is transmitted to the trigger terminal of the line latch 315, the line latch 315 latches the pixel data Data (L1) at the output terminal of the data latch 313 according to the latch signal LD, and outputs the latch content, i.e. outputs the first channel pixel data Data(L2)[1], the $x^{th}$ channel pixel data Data(L2)[x] of the pixel data Data(L2). After the previous period is ended, it is assumed that the pixel data transmitted by the timing controller 10 during a current period is "FF", the data latch 313 can latch the pixel data "FF" of different channels in the corresponding channel to replace the previous pixel data in the pervious period. For example, the data latch 313 latches "FF" in a first channel, and outputs the first channel pixel data Data(L1)[1] of the pixel data Data(L1), and latches "FF" in the $x^{th}$ channel and outputs $x^{th}$ channel pixel data Data(L1)[x] of the pixel data Data(L1), as that shown in FIG. 12.

When the current bit-data is not the complement of the previous bit-data, the comparator 341 controls the multiplexer 316 of the latch circuit 1110 through the first control signal INVER, and the multiplexer 316 selects to output the latch signal LD to the trigger terminal of the line latch 315, and the comparator 341 controls the multiplexer 331 of the DAC circuit 330 through the second control signal HV_INVER, and the multiplexer 331 selects to output the output data of the level shifter 320 to the DAC 332. When the latch signal LD is transmitted to the trigger terminal of the line latch 315 to serve as the signal M_LD, according to the latch signal LD, the line latch 315 latches the pixel data Data(L1) and outputs the pixel data Data(L2), for example, the first channel pixel data Data(L2)[1] and the $x^{th}$ channel pixel data Data(L2)[x] shown in FIG. 12.

When the current bit-data is the complement of the previous bit-data, the comparator 341 controls the multiplexer 316 of the latch circuit 1110 through the first control signal INVER, and the multiplexer 316 selects to output the disable signal to the trigger terminal of the line latch 315, and the comparator 341 controls the multiplexer 331 of the DAC circuit 330 through the second control signal HV_INVER, and the multiplexer 331 selects to output the complement of the output data of the level shifter 320 to the DAC 332. Referring to FIG. 11 and FIG. 12, since the latch signal LD is shielded, the line latch 315 does not latch the current bit-data "FF" in the line latch 315, and the pixel data Data(L2)[1]-Data(L2)[x] output by the line latch 315 is maintained to the previous bit-data "00". Therefore, the pixel data HVData[1]-HVData[x] of the level shifter 320 are maintained to the logic value "00" without transition. Therefore, when the new (current) pixel data (for example, "FF") is the complement of the old (previous) pixel data (for example, "00"), an instantaneous peak current (shown by a dot line circle 1200 of FIG. 12) of a power supply current I (VDDS) of the source driver 1100 is greatly decreased.

Figure 13:
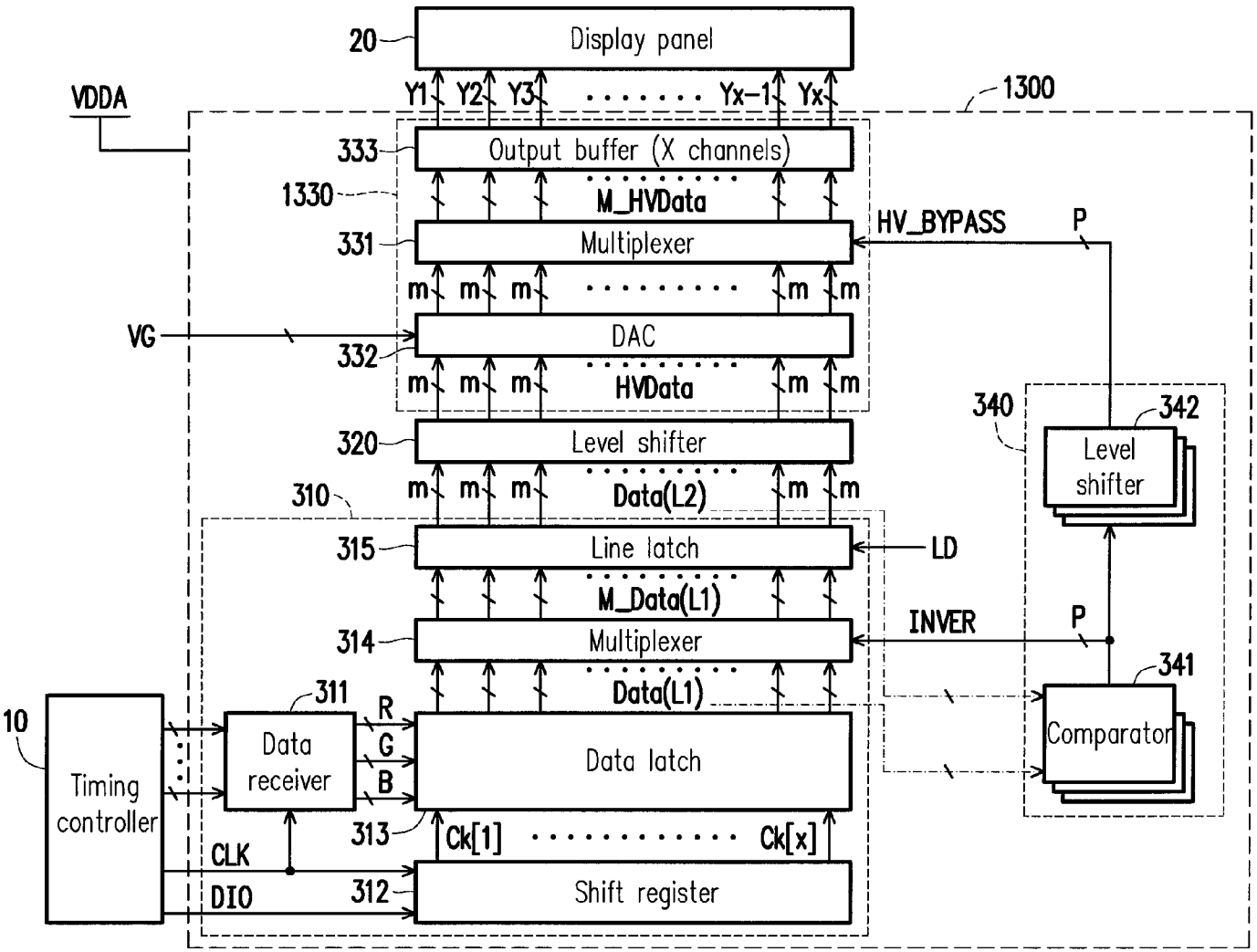
FIG. 13 is a circuit block schematic diagram of a source driver according to still another embodiment of the invention.

FIG. 13 is a circuit block schematic diagram of a source driver 1300 according to still another embodiment of the invention. The source driver 1300 is coupled between the timing controller 10 and the display panel 20. Under control of the timing controller 10, the source driver 1300 may convert the pixel data provided by the timing controller 10 into driving voltages, and use the driving voltages to drive the data lines (source lines) of the display panel 20 to display the corresponding image. The source driver 1300 includes the latch circuit 310, the level shifter 320 and a DAC circuit 1330. The latch circuit 310 receives at least one current bit-data from the timing controller 10 and latches the same, and outputs the at least one current bit-data to the input terminal of the level shifter 320 to replace at least one previous bit-data. The current bit-data can be a part of bits or all bits of pixel data in a single data channel, or can be a part of bits or all bits of pixel data in a plurality of (or even all of) data channels. Descriptions of the source driver 1300 of FIG. 13 and internal components thereof can be deduced by referring to related description of the source driver 300 of FIG. 3 or related description of the source driver 800 of FIG. 8.

The DAC circuit 1330 of FIG. 13 includes the multiplexer 331, the DAC 332 and the output buffer 333. Different to the embodiment of FIG. 3, in the embodiment of FIG. 13, the multiplexer 331 is coupled between the output terminal of the DAC 332 and the input terminal of the output buffer 333. The input terminal of the DAC 332 is coupled to the output terminal of the level shifter 320. The multiplexer 331 selects to output the output of the DAC 332, a first grayscale voltage or a second grayscale voltage to a next stage circuit according to a second control signal HV_BYPASS (referring to related description of FIG. 14).

The comparator 341 of the comparison circuit 340 compares the current bit-data (for example, the pixel data Data (L1) output by the data latch 313) with the previous bit-data (for example, the pixel data Data(L2) output by the line latch 315), and outputs the first control signal INVER to the multiplexer 314 of the latch circuit 310 according to a comparison result. The level shifter 342 converts the first control signal INVER into the second control signal HV_BYPASS and outputs the same to the multiplexer 331 of the DAC circuit 1330. The line latch 315 of the latch circuit 310 transmits the pixel data Data(L2) to the input terminal of the level shifter 320. The level shifter 320 transmits the pixel data HVData to the input terminal of the DAC 332 of the DAC circuit 1330. The DAC 332 respectively converts the pixel data in different channels into corresponding analog grayscale voltages according to the GAMMA voltage VG.

When the current bit-data is not the complement of the previous bit-data, the comparator 341 controls the multiplexer 314 of the latch circuit 310 through the first control signal INVER, and the multiplexer 314 selects to output the pixel data Data(L1) of the data latch 313 to the input terminal of the line latch 315, and the comparator 341 controls the multiplexer 331 of the DAC circuit 1330 through the second control signal HV_BYPASS, and the multiplexer 331 selects to output the output voltage of the DAC 332 to an input terminal of a next stage circuit (for example, the output buffer 333). When the current bit-data is the complement of the previous bit-data, the comparator 341 controls the multiplexer 314 through the first control signal INVER, and the multiplexer 314 selects to output the complement of the pixel data Data(L1) to the input terminal of the line latch 315, and the comparator 341 controls the multiplexer 331 of the DAC circuit 1330 through the second control signal HV_BYPASS, and the multiplexer 331 selects to output a first grayscale voltage (the minimum grayscale voltage, for example, the grayscale voltage corresponding to the pixel data "00") or a second grayscale voltage (the maximum grayscale voltage, for example, the grayscale voltage corresponding to the pixel data "FF") to a next stage circuit.

Figure 14:
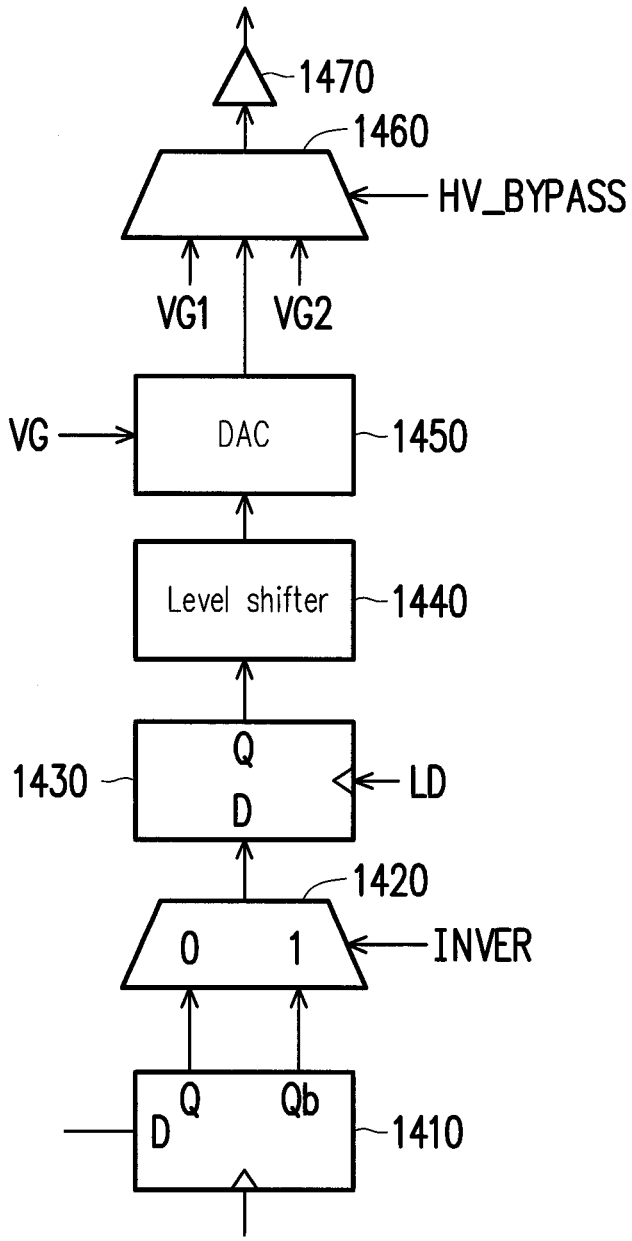
FIG. 14 is a schematic diagram of an implementation of a multiplexer of FIG. 13 according to an embodiment of the invention.

FIG. 14 is a schematic diagram of an implementation of the multiplexer of FIG. 13 according to an embodiment of the invention. The circuit shown in FIG. 14 is a schematic diagram of a single-bit circuit. Those skilled in the art may deduce the multi-bit circuit according to the instruction of the present embodiment. The circuit shown in FIG. 14 can be regarded as a circuit of one of a plurality of bits in multiple channels of FIG. 13. A data latch 1410, a multiplexer 1420, a line latch 1430, a level shifter 1440, a DAC 1450, a multiplexer 1460, and an output buffer 1470 of FIG. 14 are similar to the data latch 313, the multiplexer 314, the line latch 315, the level shifter 320, the DAC 332, the multiplexer 331 and the output buffer 333 of FIG. 13.

Descriptions of the data latch 1410, the multiplexer 1420, the line latch 1430, the level shifter 1440, the DAC 1450 and the output buffer 1470 of FIG. 14 can be deduced by referring to related descriptions of the data latch 610, the multiplexer 620, the line latch 630, the level shifter 640, the DAC 660 and the output buffer 670 of FIG. 6. Different to the embodiment of FIG. 6, in the embodiment of FIG. 14, the multiplexer between the level shifter 1440 and the DAC 1450 is omitted, and the multiplexer 1460 is configured between the output terminal of the DAC 1450 and the input terminal of the output buffer 1470.

When the current bit-data is not the complement of the previous bit-data, the multiplexer 1420 selects to transmit the current bit-data output from the non-inverted output terminal Q of the data latch 1410 to the input terminal D of the line latch 1430 according to the first control signal INVER, and the multiplexer 1460 selects to transmit the output voltage of the DAC 1450 to an input terminal of a next stage circuit (for example, the output buffer 1470) according to the second control signal HV_BYPASS. When the current bit-data is the minimum value (for example, "00") and the previous bit-data is the maximum value (for example, "FF"), the multiplexer 1420 selects to transmit the data output from the inverted output terminal Qb of the data latch 1410 (i.e. the complement of the current bit-data) to the input terminal D of the line latch 1430 according to the first control signal INVER, and the multiplexer 1460 selects to transmit the first grayscale voltage VG1 to the next stage circuit according to the second control signal HV_BYPASS. The first grayscale voltage VG1 can be a grayscale voltage corresponding to the pixel data "00" in a plurality of GAMMA voltages VG, for example, the minimum grayscale voltage in the GAMMA voltages VG. When the current bit-data is the maximum value (for example, "FF") and the previous bit-data is the minimum value (for example, "00"), the multiplexer 1420 selects to transmit the data output from the inverted output terminal Qb of the data latch 1410 (i.e. the complement of the current bit-data) to the input terminal D of the line latch 1430 according to the first control signal INVER, and the multiplexer 1460 selects to transmit the second grayscale voltage VG2 to the next stage circuit according to the second control signal HV_BYPASS. The second grayscale voltage VG2 can be a grayscale voltage corresponding to the pixel data "FF" in a plurality of GAMMA voltages VG, for example, the maximum grayscale voltage in the GAMMA voltages VG.

Figure 15:
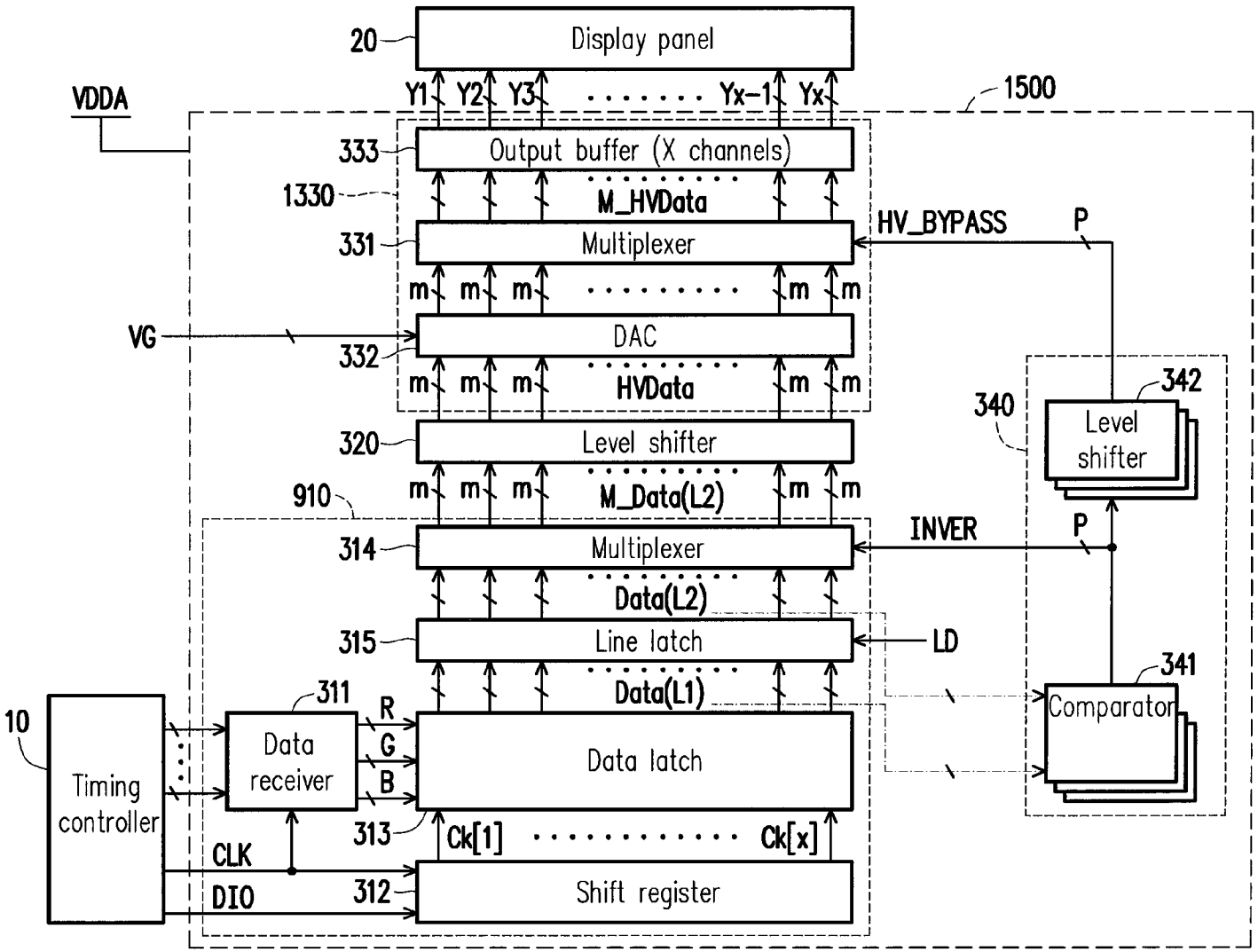
FIG. 15 is a circuit block schematic diagram of a source driver according to still another embodiment of the invention.

FIG. 15 is a circuit block schematic diagram of a source driver 1500 according to still another embodiment of the invention. The source driver 1500 is coupled between the timing controller 10 and the display panel 20. Under control of the timing controller 10, the source driver 1500 may convert the pixel data provided by the timing controller 10 into driving voltages, and use the driving voltages to drive the data lines (source lines) of the display panel 20 to display the corresponding image. The source driver 1500 includes the latch circuit 910, the level shifter 320 and the DAC circuit 1330. Descriptions of the source driver 1500 of FIG. 15 and internal components thereof can be deduced by referring to related descriptions of the source driver 300 of FIG. 3, the source driver 800 of FIG. 8, the source driver 900 of FIG. 9 or the source driver 1300 of FIG. 13. For example, the latch circuit 910 of FIG. 15 may refer to related description of the embodiment of FIG. 9, and the DAC circuit 1330 of FIG. 15 may refer to related descriptions of the embodiments of FIG. 13 and FIG. 14. Referring to FIG. 15, when the current bit-data is the complement of the previous bit-data, the comparator 341 controls the multiplexer 314 through the first control signal INVER, and the multiplexer 314 selects to output the complement of the pixel data Data(L2) to the input terminal of the level shifter 320, and the comparator 341 controls the multiplexer 331 through the second control signal HV_BYPASS, and the multiplexer 331 selects to transmit the first grayscale voltage or the second grayscale voltage in the GAMMA voltages VG to a next stage circuit.

Figure 16:
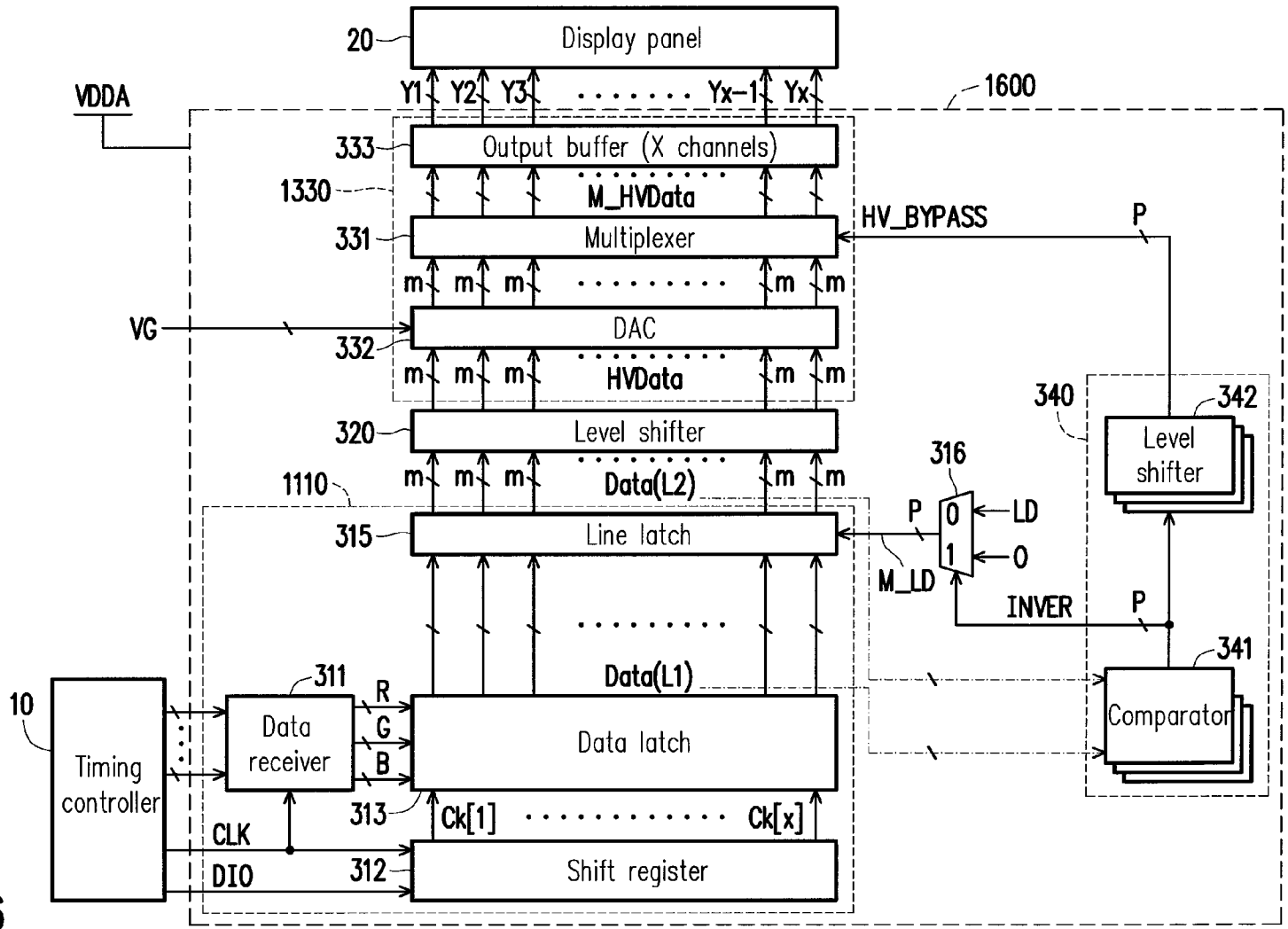
FIG. 16 is a circuit block schematic diagram of a source driver according to still another embodiment of the invention.

FIG. 16 is a circuit block schematic diagram of a source driver 1600 according to still another embodiment of the invention. The source driver 1600 is coupled between the timing controller 10 and the display panel 20. Under control of the timing controller 10, the source driver 1600 may convert the pixel data provided by the timing controller 10 into driving voltages, and use the driving voltages to drive the data lines (source lines) of the display panel 20 to display the corresponding image. The source driver 1600 includes the latch circuit 1110, the level shifter 320 and the DAC circuit 1330. Descriptions of the source driver 1600 of FIG. 16 and internal components thereof can be deduced by referring to related descriptions of the source driver 300 of FIG. 3, the source driver 800 of FIG. 8, the source driver 1100 of FIG. 11 or the source driver 1300 of FIG. 13. For example, the latch circuit 1110 of FIG. 16 may refer to related description of the embodiment of FIG. 11, and the DAC circuit 1330 of FIG. 16 may refer to related descriptions of the embodiments of FIG. 13 and FIG. 14. Referring to FIG. 16, when the current bit-data is the complement of the previous bit-data, the comparator 341 controls the multiplexer 314 through the first control signal INVER, and the multiplexer 314 selects to output the complement of the pixel data Data(L2) to the input terminal of the level shifter 320, and the comparator 341 controls the multiplexer 331 of the DAC circuit 1330 through the second control signal HV_BYPASS, and the multiplexer 331 selects to transmit the first grayscale voltage or the second grayscale voltage in the GAMMA voltages VG to a next stage circuit.

In summary, the embodiments of the invention can determine data, and the peak current is reduced according to the determination result. A determination circuit (for example, the comparison circuit 340 or the timing controller 30) can determine whether the current bit-data is the complement of the previous bit-data. In some embodiments, the current bit-data can be a part of bits or all bits of the pixel data Data(L1) output by the data latch 313, and the previous bit-data can be a part of bits or all bits of the pixel data Data(L2) output by the line latch 315. The determination circuit correspondingly controls the multiplexer (for example, the multiplexer 314, 316 and/or 331) according to the determination result. If the determination result indicates that the current bit-data is the complement of the previous bit-data, the complement of the current bit-data is transmitted to the level shifter 320 to avoid the peak current generated during data transition. While the complement of the current bit-data is transmitted to the level shifter 320, the multiplexer 331 between the output terminal of the level shifter 320 and the input terminal of the DAC 332 can restore the complement of the current bit-data to the current bit-data. If the determination result indicates that the current bit-data is not the complement of the previous bit-data, the current bit-data is transmitted to the level shifter 320. Since the current bit-data is not the complement of the previous bit-data, the data transition does not cause excessive peak current.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A source driver, comprising:

a level shifter;

a latch circuit, latching at least one current bit-data, wherein the latch circuit selects and outputs the at least one current bit-data to an input terminal of the level shifter to replace at least one previous bit-data when the at least one current bit-data is not a complement of the at least one previous bit-data, and the latch circuit selects and outputs the at least one previous bit-data to the input terminal of the level shifter when the at least one current bit-data is the complement of the at least one previous bit-data; and a digital-to-analog converter (DAC) circuit, coupled to an output terminal of the level shifter, wherein the DAC circuit outputs a voltage corresponding to output data of the level shifter when the at least one current bit-data is not a complement of the at least one previous bit-data, and the DAC circuit outputs a voltage corresponding to the at least one current bit-data when the at least one current bit-data is the complement of the at least one previous bit-data.

2. The source driver as claimed in claim 1, wherein the at least one current bit-data is a part of bits or all bits of data in one channel of the source driver.

3. The source driver as claimed in claim 1, wherein the at least one current bit-data is a part of bits or all bits of data in a plurality of channels of the source driver.

4. The source driver as claimed in claim 1, wherein the latch circuit comprises:

a data latch, latching and outputting the at least one current bit-data;

a line latch, having an output terminal coupled to the input terminal of the level shifter, wherein the line latch latches data at an input terminal of the line latch according to a latch signal; and a multiplexer, coupled between an output terminal of the data latch and the input terminal of the line latch, wherein the multiplexer selects to output the at least one current bit-data output by the data latch or a complement of the at least one current bit-data to the input terminal of the line latch according to a first control signal.

5. The source driver as claimed in claim 1, wherein the latch circuit comprises:

a data latch, latching and outputting the at least one current bit-data;

a line latch, having an input terminal coupled to an output terminal of the data latch, wherein the line latch latches data at the input terminal of the line latch according to a latch signal; and a multiplexer, coupled between the output terminal of the line latch and the input terminal of the level shifter, wherein the multiplexer selects to output the at least one current bit-data output by the line latch or a complement of the at least one current bit-data to the input terminal of the level shifter according to a first control signal.

6. The source driver as claimed in claim 1, wherein the latch circuit comprises:

a data latch, latching and outputting the at least one current bit-data;

a line latch, having an input terminal coupled to an output terminal of the data latch, and an output terminal coupled to the input terminal of the level shifter, wherein the line latch latches data at the input terminal of the line latch according to a signal at a trigger terminal of the line latch; and a multiplexer, coupled to the trigger terminal of the line latch, wherein the multiplexer selects to transmit a latch signal or a disable signal to the trigger terminal of the line latch according to a first control signal.

7. The source driver as claimed in claim 1, wherein the DAC circuit comprises:

a digital-to-analog converter; and a multiplexer, coupled between the output terminal of the level shifter and an input terminal of the digital-to-analog converter, wherein the multiplexer selects to transmit an output of the level shifter or a complement of the output of the level shifter to the input terminal of the digital-to-analog converter according to a second control signal.

8. The source driver as claimed in claim 1, wherein the DAC circuit comprises:

a digital-to-analog converter, having an input terminal coupled to the output terminal of the level shifter; and a multiplexer, coupled to an output terminal of the digital-to-analog converter, wherein the multiplexer selects to transmit an output of the digital-to-analog converter, a first grayscale voltage or a second grayscale voltage to a next stage circuit according to a second control signal.

9. The source driver as claimed in claim 1, further comprising:

a comparison circuit, coupled to the latch circuit and the DAC circuit, wherein the comparison circuit compares the at least one current bit-data with the at least one previous bit-data;

wherein when the at least one current bit-data is not the complement of the at least one previous bit-data, the comparison circuit controls the latch circuit to select and output the at least one current bit-data to the input terminal of the level shifter, and the comparison circuit controls the DAC circuit to output a voltage corresponding to output data of the level shifter; and wherein when the at least one current bit-data is the complement of the at least one previous bit-data, the comparison circuit controls the latch circuit to select and output the at least one previous bit-data to the input terminal of the level shifter, and the comparison circuit controls the DAC circuit to output a voltage corresponding the at least one current bit-data.

10. The source driver as claimed in claim 9, wherein the comparison circuit comprises:

a comparator, coupled to the latch circuit, wherein the comparator compares the at least one current bit-data and the at least one previous bit-data, and correspondingly outputs a first control signal to the latch circuit according to a comparison result, so as to control the latch circuit to select and output the at least one current bit-data or the at least one previous bit-data to the input terminal of the level shifter; and a second level shifter, coupled between the comparator and the DAC circuit, wherein the second level shifter converts the first control signal into a second control signal to the DAC circuit, so as to control the DAC circuit to output a voltage corresponding to output data of the level shifter or a voltage corresponding to the at least one current bit-data.

11. The source driver as claimed in claim 1, wherein the latch circuit and the DAC circuit are controlled by a timing controller.

12. A method for reducing peak current of a source driver, comprising:

comparing at least one current bit-data and at least one previous bit-data;

selecting and outputting the at least one current bit-data to an input terminal of a level shifter of the source driver to replace the at least one previous bit-data when the at least one current bit-data is not a complement of the at least one previous bit-data;

using a digital-to-analog converter (DAC) circuit to convert output data of the level shifter to a corresponding voltage when the at least one current bit-data is not a complement of the at least one previous bit-data;

selecting and outputting the at least one previous bit-data to the input terminal of the level shifter when the at least one current bit-data is the complement of the at least one previous bit-data; and using the DAC circuit to output a voltage corresponding to the at least one current bit-data when the at least one current bit-data is the complement of the at least one previous bit-data.

13. The method for reducing peak current of the source driver as claimed in claim 12, wherein the at least one current bit-data is a part of bits or all bits of data in one channel of the source driver.

14. The method for reducing peak current of the source driver as claimed in claim 12, wherein the at least one current bit-data is a part of bits or all bits of data in a plurality of channels of the source driver.

15. The method for reducing peak current of the source driver as claimed in claim 12, wherein the DAC circuit comprises a digital-to-analog converter; the output data of the level shifter is selected and transmitted to an input terminal of the digital-to-analog converter when the at least one current bit-data is not the complement of the at least one previous bit-data; and a complement of the output data of the level shifter is selected and transmitted to the input terminal of the digital-to-analog converter when the at least one current bit-data is the complement of the at least one previous bit-data.

16. The method for reducing peak current of the source driver as claimed in claim 12, wherein the DAC circuit comprises a digital-to-analog converter coupled to an output terminal of the level shifter; an output of the digital-to-analog converter is selected and transmitted to a next stage circuit when the at least one current bit-data is not the complement of the at least one previous bit-data; and a first grayscale voltage or a second grayscale voltage is selected and transmitted to the next stage circuit when the at least one current bit-data is the complement of the at least one previous bit-data.

* * * * *